US011636833B2

(12) United States Patent
Wish

(10) Patent No.: US 11,636,833 B2
(45) **Date of Patent: *Apr. 25, 2023**

(54) GO DRUM

(71) Applicant: David Wish, Montclair, NJ (US)

(72) Inventor: David Wish, Montclair, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/236,793

(22) Filed: Apr. 21, 2021

(65) Prior Publication Data

US 2021/0241727 A1 Aug. 5, 2021

Related U.S. Application Data

(63) Continuation-in-part of application No. 17/152,682, filed on Jan. 19, 2021, now abandoned, which is a continuation of application No. 16/867,519, filed on May 5, 2020, now Pat. No. 10,896,662, which is a continuation-in-part of application No. 16/025,876, filed on Jul. 2, 2018, now Pat. No. 10,714,061, which is a continuation of application No. 15/430,431, filed on Feb. 10, 2017, now Pat. No. 10,013,960.

(51) Int. Cl.

| | |
|---|---|
| ***G10D 13/02*** | (2020.01) |
| ***G10D 13/06*** | (2020.01) |
| ***G10D 13/11*** | (2020.01) |
| ***G10D 13/18*** | (2020.01) |

(52) U.S. Cl.

CPC ..... *G10D 13/02* (2013.01); *G10D 13/06* (2013.01); *G10D 13/11* (2020.02); *G10D 13/18* (2020.02)

(58) Field of Classification Search

CPC ..... G10D 13/02; G10D 13/06; G10D 13/11; G10D 13/18; G10D 13/063

See application file for complete search history.

(56) References Cited

U.S. PATENT DOCUMENTS

| | | | | |
|---|---|---|---|---|
| 3,326,074 | A | 1/1967 | Osty et al. | |
| 6,211,448 | B1 | 4/2001 | Shigenaga et al. | |
| 8,927,842 | B1 | 1/2015 | Honjo | |
| 10,013,960 | B1 * | 7/2018 | Wish | G10D 13/11 |
| 10,714,061 | B2 | 7/2020 | Wish | |
| 10,896,662 | B2 | 1/2021 | Wish | |
| 2007/0221040 | A1 | 9/2007 | Bailey | |
| 2009/0255394 | A1 | 10/2009 | Jeffries et al. | |

* cited by examiner

*Primary Examiner* — Kimberly R Lockett

(74) *Attorney, Agent, or Firm* — Manatt, Phelps & Phillips, LLP

(57) ABSTRACT

A compact drum kit is provided. The drum kit has a body having a hollow interior cavity and a sound hole for transmitting sound wave from the interior cavity to exterior of the body, the body has a striking head and an opposing resonant head. The drum kit has a top plate attaching to a top side of the body and a platform attaching to a bottom side of the body. A plurality of upward extending component mounting shafts are supported by shaft locking mechanisms. A drum kick assembly is positioned on the striking head side of the body and including a beater positioned to strike the striking head of the body to produce a sound. A hi-hat pedal assembly is positioned on the resonant head side of the body. The hi-hat pedal assembly can be attached to a hi-hat pedal assembly plate at a variety of distances and angles. The hi-hat pedal assembly plate can be pivotally connected to the bottom platform that the hi-hat pedal plate forms a portion of the body when the hi-hat pedal assembly plate is folded up for storage.

20 Claims, 25 Drawing Sheets

GO DRUM

CROSS-REFERENCE TO RELATED APPLICATIONS

This application is a continuation-in-part of U.S. patent application Ser. No. 17/152,682, filed on Jan. 19, 2021, which is a continuation of U.S. patent application Ser. No. 16/867,519, filed on May 5, 2020, now U.S. Pat. No. 10,896,662, which is a continuation-in-part of U.S. patent application Ser. No. 16/025,876, filed on Jul. 2, 2018, now U.S. Pat. No. 10,714,061, which is a continuation of U.S. patent application Ser. No. 15/430,431, filed on Feb. 10, 2017, now U.S. Pat. No. 10,013,960. All of the above applications are incorporated herein by reference in their entirety.

BACKGROUND

Technical Field

This disclosure relates generally to musical instruments and more specifically relates to a drum set.

Related Art

A drum kit, drum set, trap set, or just drums is a collection of drums and other percussion instruments set up to be played/struck by a single player. The traditional drum kit consists of a mix of drums (classified as classically as membranophones, Hornbostel-Sachs high-level classification 2) and idiophones (Hornbostel-Sachs high-level classification 1, most significantly cymbals but also including the woodblock and cowbell for example). More recently kits have also included electronic instruments (Hornbostel-Sachs classification 53), with both hybrid and entirely electronic kits now in common use.

A standard modern kit (for a right-handed player), as used in popular music and taught in many music schools, contains: a snare drum, mounted on a stand, placed between the player's knees and played with drum sticks (which may include rutes or brushes); a bass drum, played by a pedal operated by the right foot; and one or more cymbals, played with the sticks.

All of these are classed as non-pitched percussion, allowing for the music to be scored using percussion notation, for which a loose semi-standardized form exists for the drum kit. If some or all of them are replaced by electronic drums, the scoring and most often positioning remains the same, allowing a standard teaching approach. The drum kit is usually played seated on a drum stool or throne. The drum kit differs in general from those traditional instruments that produce melody or chords/pitch per se: even though drums are often placed musically alongside others that do, such as the piano or stringed instruments.

Many drummers extend their kits from this basic pattern, adding more drums, more cymbals, and many other instruments including pitched percussion. In some styles of music particular extensions are normal, for example double bass drums in heavy metal music. On the other extreme but more rarely, some performers omit elements from even the basic setup, also dependent on the style of music and individual preferences.

DESCRIPTION OF EXEMPLARY EMBODIMENTS

Figure 1:
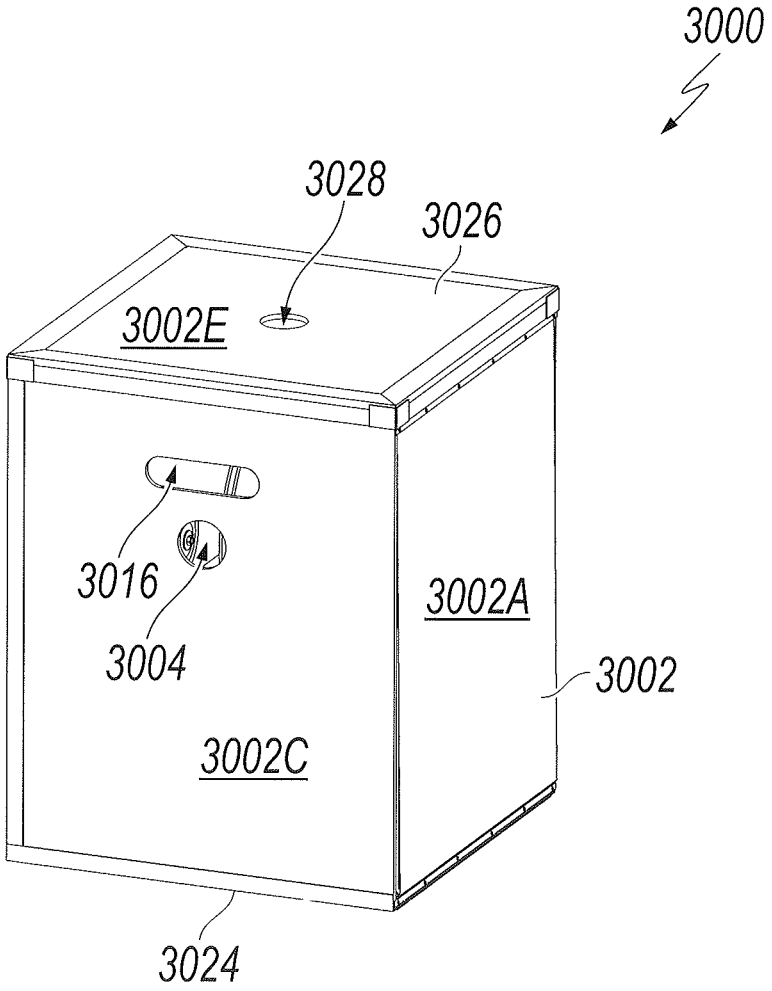
FIG. 1 illustrates a top-front-right perspective view of an exemplary go drum that is in a storage position.

Traditional drum sets are very large and comprise both a large number of components and components, many of which, are large in size. Traditional drum sets are not ideal for students because drum sets are both expensive and they take up a lot of space. Traditional drum sets are also not ideal for a classroom setting, where the goal is to teach students how to play the drums. The go drum is an all-in-one drum kit. The go drum is a compact, versatile, highly portable, and self-contained drum kit.

The figures illustrate an example embodiment of a drum kit (go drum) 3000, also referred to as the go drum. Reference now will be made in detail to embodiments of the disclosure, one or more examples of which are illustrated in the figures. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

FIGS. 1-11 illustrate a variety of views of an exemplary go drum 3000 that is in a storage position according to the present disclosure. The go drum 3000 includes generally a body (or kick drum) 3002. Body 3002 comprises a hollow interior 3020 and may be defined by a right side 3002A, a left side 3002B, a front side 3002C, a rear side 3002D, a top side 3002E, and a bottom side 3002F. Particular embodiments of body 3002 may be a polyhedron of any three dimensional shape, including, but not limited to, a cube, a cylinder that is round or having a top and bottom of any other polygonal shape, a pyramid that is upright or inverted, whole or bisected, having a base comprising a square or any other polygon, and a cone, whole or bisected. In particular embodiments, body 3002 may be a box, crate, case, chest, bongo, polygonal with supporting dome, or any other shape in which it would project a sound like a drum when played. In particular embodiments the sides of body 3002, the sides of the cylinder may be perpendicular to the top and bottom, or the sides may be non-perpendicular, at an angle more or less than 90 degrees to the top and bottom of body 3002.

In particular embodiments, the go drum 3000 is an extremely portable, all-inclusive drum set. Specifically, portability is a particular advantage of the go drum 3000. In particular embodiments, when it is fully packed-up, there are very few protrusions from the body 3002, which makes the go drum highly portable, easy to carry, and easy to transport.

In particular example embodiments, go drum 3000 may be carried by hand hold 3016. In the figures, hand hold 3016 is shown on the front side 3002C and the rear side 3002D of body 3002. Nevertheless, hand hold could be placed on any side of body 3002. As shown in the figures, particular example embodiments of hand hold 3016 comprise an elongated hole in body 3002. In particular embodiments, there may be one or more hand holds 3016 on body 3002. In particular embodiments, hand hold 3016 may be a strap, grip, protrusion, or any other mechanism that enables a person to carry go drum 3000.

In particular exemplary embodiments, a platform 3024 is positioned beneath the body 3002. In particular exemplary embodiments, the platform 3024 is sized to cover and extend from the bottom of the body 3002. In particular exemplary embodiments, the bottom of the body 3002 formed a portion of the platform 3024. In particular exemplary embodiments, the bottom of the body 3002 is the platform 3024. Although platform 3024 is shown as a flat plate, platform 3024 may be any suitable form or any shape to facilitate maintaining the body 3002 in a position desirable to be able to play go drum 3000.

In particular exemplary embodiments, a top plate 3026 is positioned above the body 3002. In particular exemplary embodiments, the top plate 3026 is sized to cover and extend from the top of the body 3002. In particular exemplary embodiments, the top of the body 3002 formed a portion of the top plate 3026. In particular exemplary embodiments, the top of the body 3002 is the top plate 3026.

Body 3002, platform 3024 and top plate 3026 may be made of any suitable material, including but not limited to wood, carbon fiber, fiber glass, metal, plastic, and the like.

In particular exemplary embodiments, there are a number of features of body 3002 to enable body 3002 to behave as a drum. In particular embodiments, body 3002 may have one or more sound holes 3004 on a side of body 3002 from which sound emanates depending on whether the top or another side of the body 3002 is struck.

As shown in the figures, body 3002 has a striking side or striking head that may be struck by a beater of a drum kick assembly. In particular embodiments, the right side 3002A of the body 3002 formed the striking side. When beater 3088 strikes striking head 3002A, it creates oscillations on the striking head 3002A and sound waves carrying corresponding frequencies would travel through sound hole 3004. In particular embodiments, striking head 3002A may comprise any shape, including but not limited to a rectangle, square or other polygon having a plurality of sides. In particular embodiments, striking head 3002A may be comprised of the same material as body 3002. In particular embodiments, striking head 3002A may be comprised of mylar. In particular embodiments, striking head 3002A may be tunable. In particular embodiments, striking head 3002A can be tuned by means of one or more tension rods that run substantially the whole length of one side of the striking head 3002A. Alternatively, striking head 3002A can be tuned by means of one or more tension bolts that protrude a portion along a side of the surface of the striking head 3002A. In particular embodiments, striking head 3002A may be tunable and comprised of mylar.

As shown in the figures, body 3002 has a resonant side or resonant head 3002B that is positioned on the opposite side of the striking side 3002A. In particular embodiments, the left side 3002B of the body 3002 formed the resonant side. When beater 3088 strikes striking head 3002A, sound waves carrying resonant frequencies due to oscillations of the resonant head 3002B would travel through sound hole 3004. In particular embodiments, resonant head 3002B is comprised of the same dimension and the same material as striking head 3002A to generate corresponding resonant frequency. In particular embodiments, resonant head 3002B may be comprised of mylar. In particular embodiments, resonant head 3002B may be tunable. In particular embodiments, resonant head 3002B can be tuned by means of one or more tension rods that run substantially the whole length of one side of the resonant head 3002B. Alternatively, resonant head 3002B can be tuned by means of one or more tension bolts that protrude a portion along a side of the surface of the resonant head 3002B. In particular embodiments, resonant head 3002B may be tunable and comprised of mylar.

The top of body 3002 has a top component 3040 that may be struck. When top component 3040 is struck, sound also travels through sound hole 3004. Although in particular embodiments go drum 3000 has a sound hole 3004 on a particular side of body 3002, a sound hole may be located on any side of go drum 3000. In particular embodiments, go drum 3000 may have no sound hole at all or may have any number of sound holes more than one sound hole. In particular embodiments, a sound hole may comprise any size from very small to an entire side or the bottom of body 3002 may be open and functionally behave as a sound hole.

Figure 2:
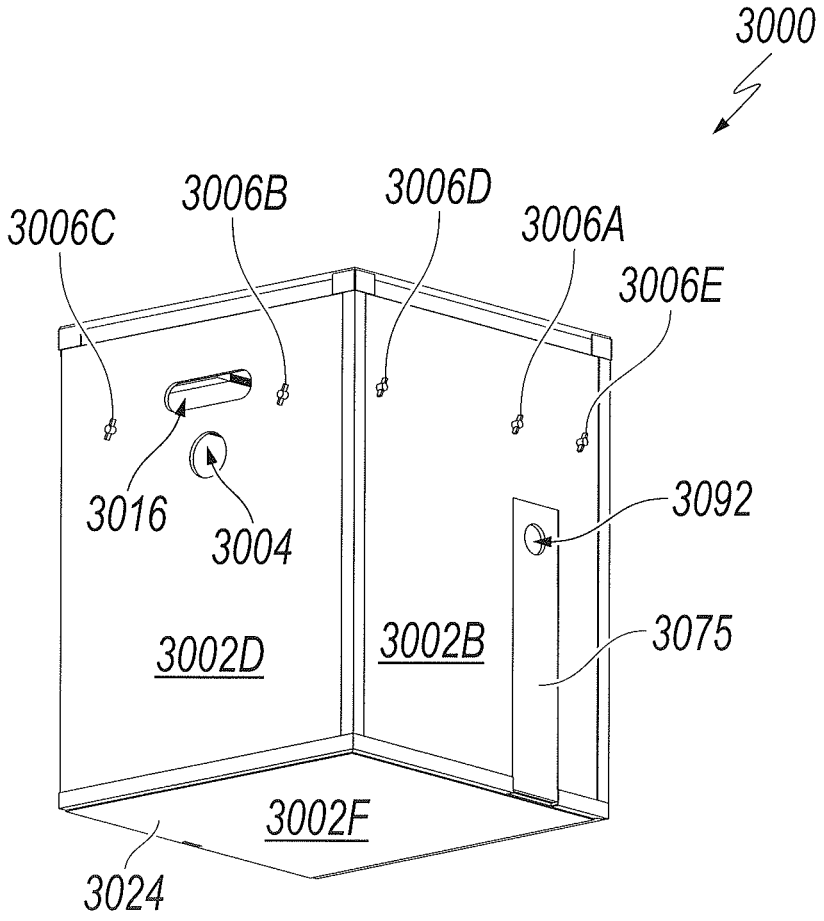
FIG. 2 illustrates a bottom-rear-left perspective view of the exemplary go drum of FIG. 1 showing an embodiment with a plate for hi-hat pedal in a closed position.
Figure 3:
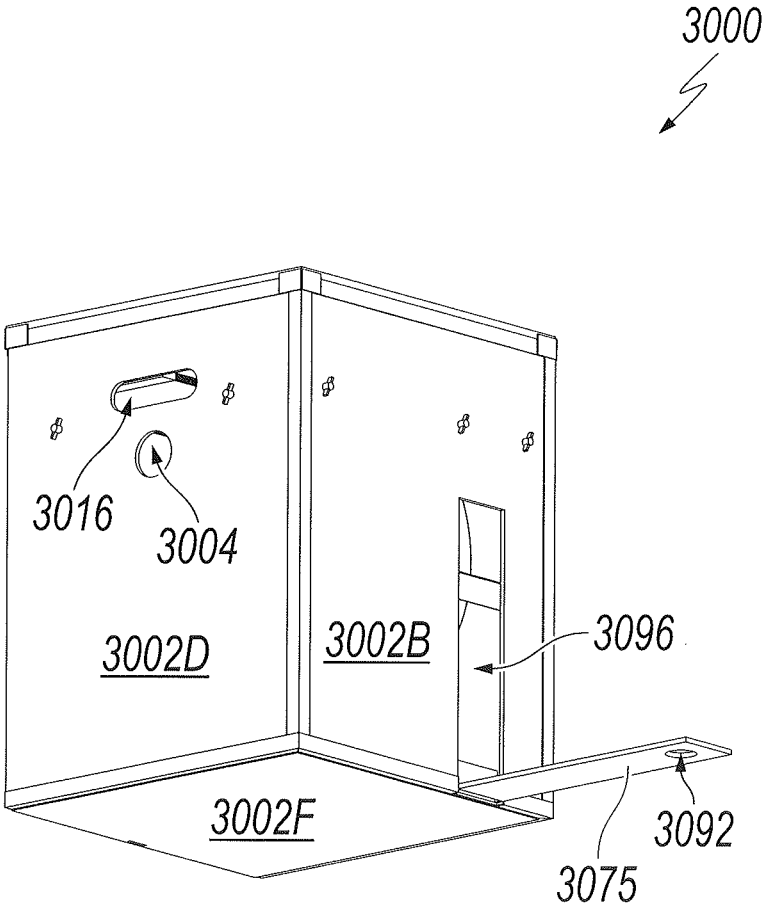
FIG. 3 illustrates a bottom-rear-left perspective view of the exemplary go drum of FIG. 2 with the plate for hi-hat pedal in an open position.

In some embodiments, as shown in FIGS. 2-3, the left side 3002B of the body 3002 has an opening or cut-out 3096 sized to receive a hi-hat pedal assembly plate 3075, which can be pivotally connected, for example, by a hinge or strap, to the bottom platform 3024 that the hi-hat pedal plate 3075 can be folded up (as shown in FIG. 2) for storage or during transportation. The surface of the hi-hat pedal assembly plate 3075 and the outer surface of the left side 3002B of body 3002 can lay substantially flat. In this configuration, the hi-hat pedal assembly plate 3075 form a part of the body 3002. When the hi-hat pedal assembly plate 3075 is folded up for storage, it can be held closed by, for example, velcro, magnets, latches or other fastening mechanisms. An access hole 3092 can be provided on the hi-hat pedal assembly plate 3075 to facilitate pulling the hi-hat pedal assembly plate 3075 pivotally away from the body and lay substantially horizontal (as shown in FIG. 3) for supporting the hi-hat pedal assembly.

Figure 4:
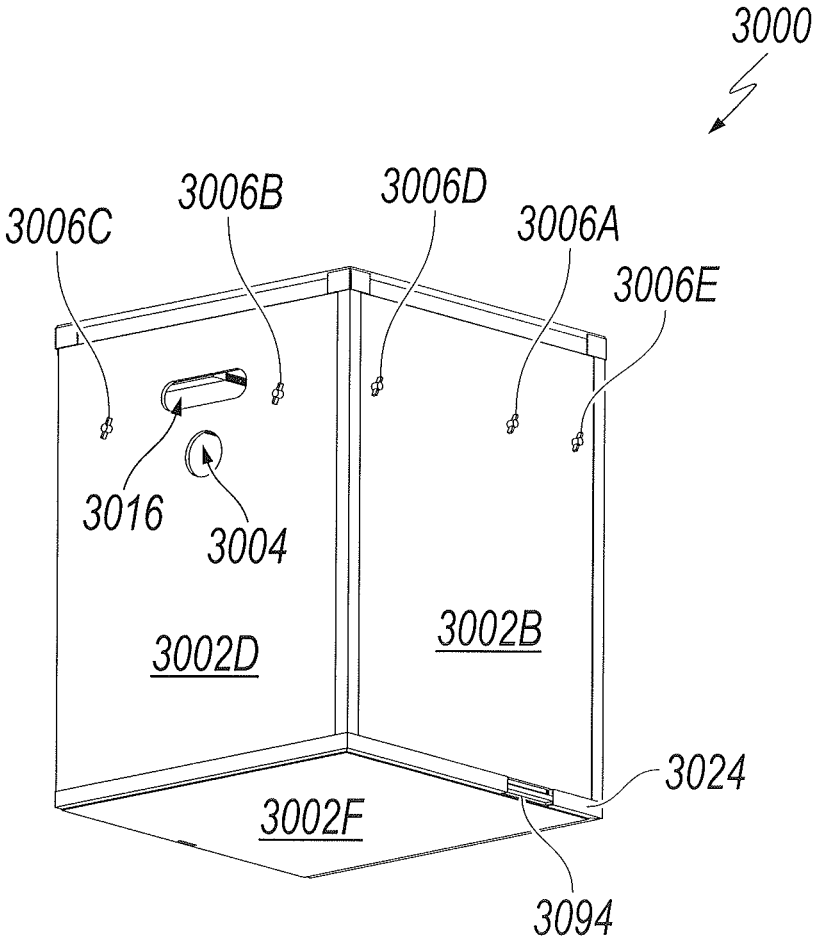
FIG. 4 illustrates a bottom-rear-left perspective view of the exemplary go drum of FIG. 1 showing an embodiment with an access slot for a plate for hi-hat pedal.
Figure 5:
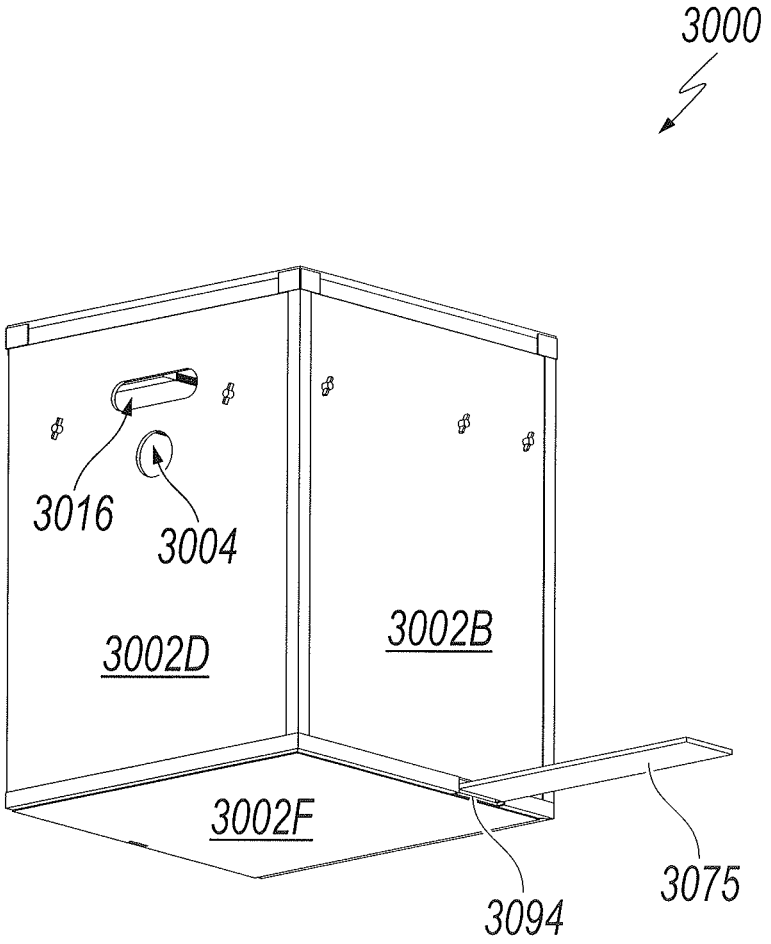
FIG. 5 illustrates a bottom-rear-left perspective view of the exemplary go drum of FIG. 4 with a plate for hi-hat pedal extended from the access slot.
Figure 6:
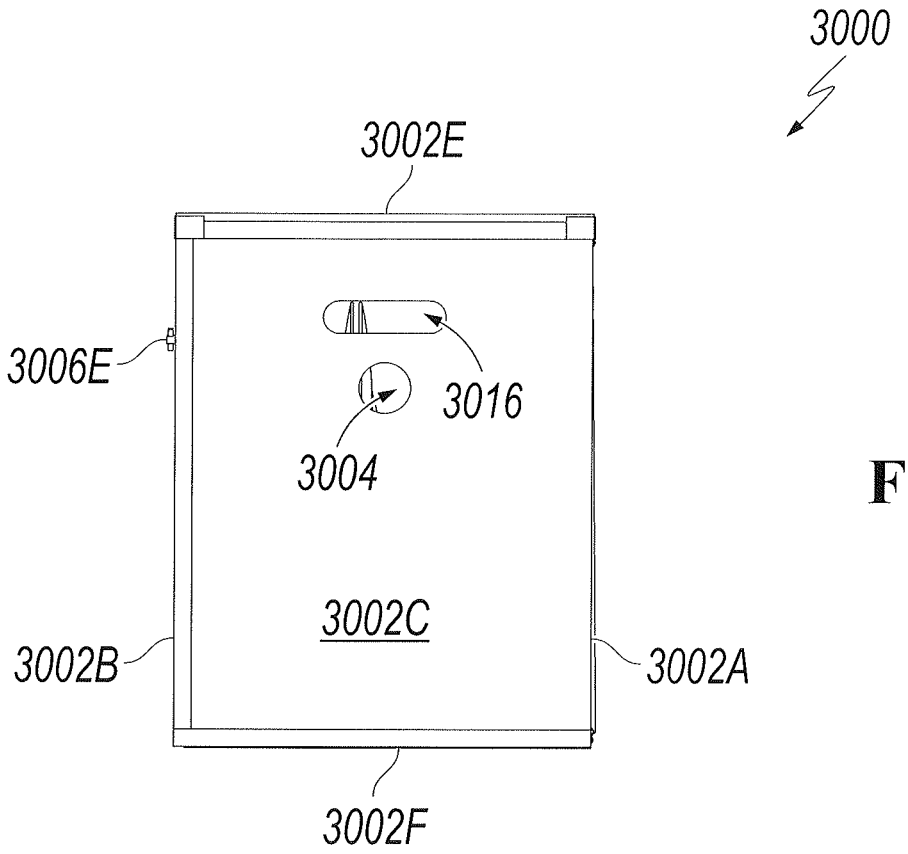
FIG. 6 illustrates a front view of the exemplary go drum of FIG. 1 that is in a storage position.
Figure 7:
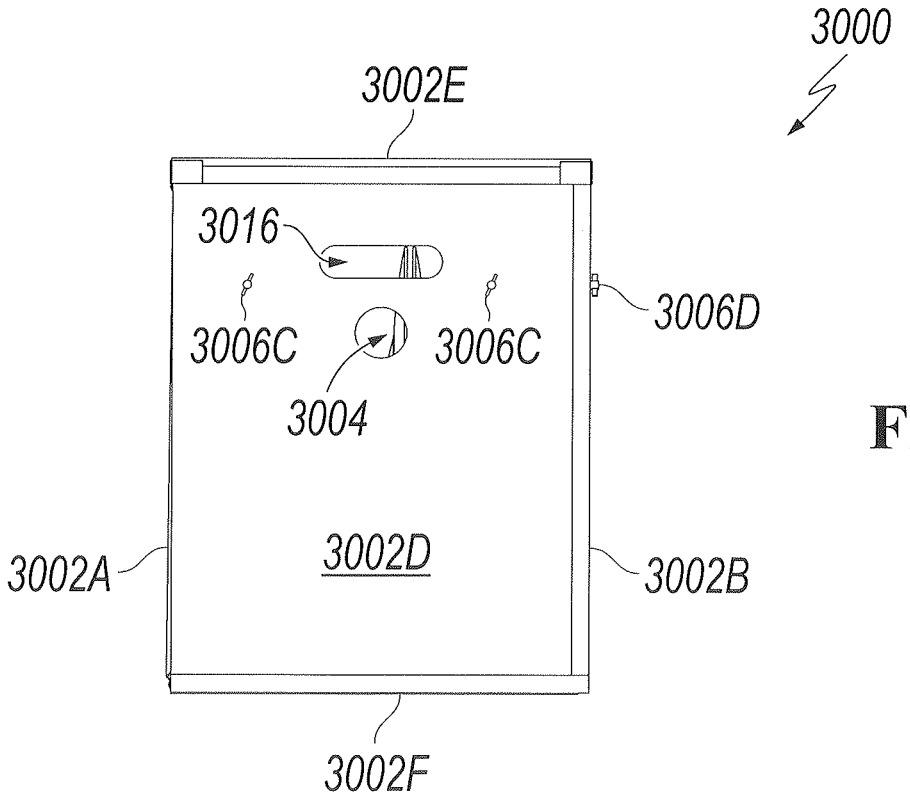
FIG. 7 illustrates a rear view of the exemplary go drum of FIG. 1 that is in a storage position.
Figure 8:
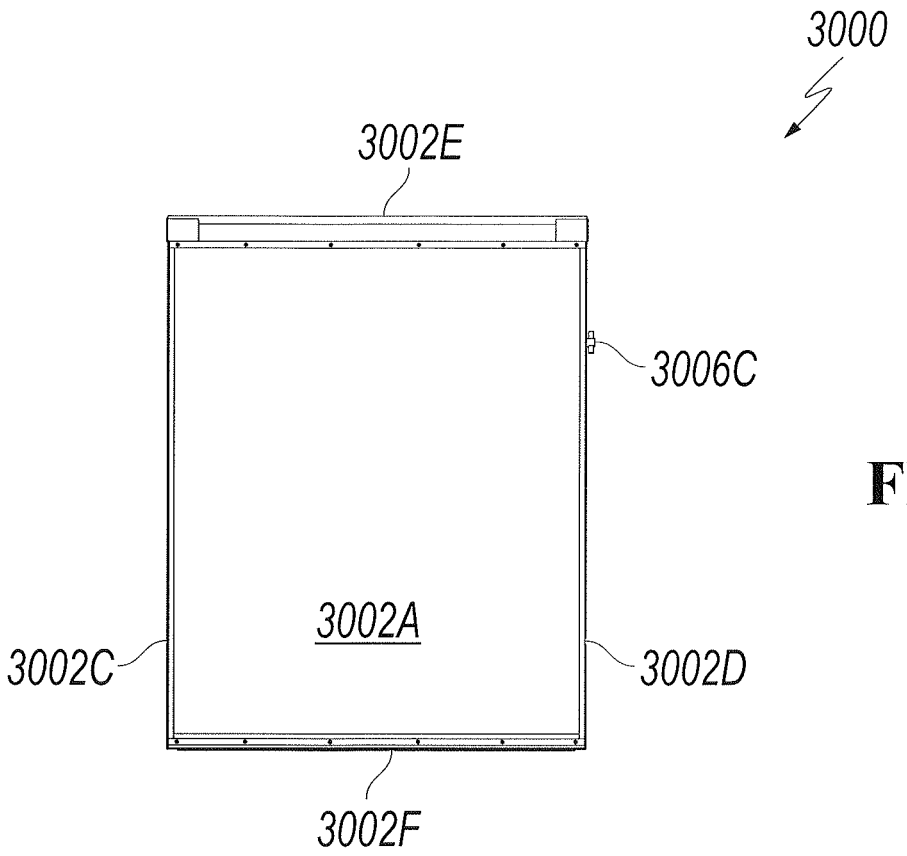
FIG. 8 illustrates a right view of the exemplary go drum of FIG. 1 that is in a storage position.
Figure 9:
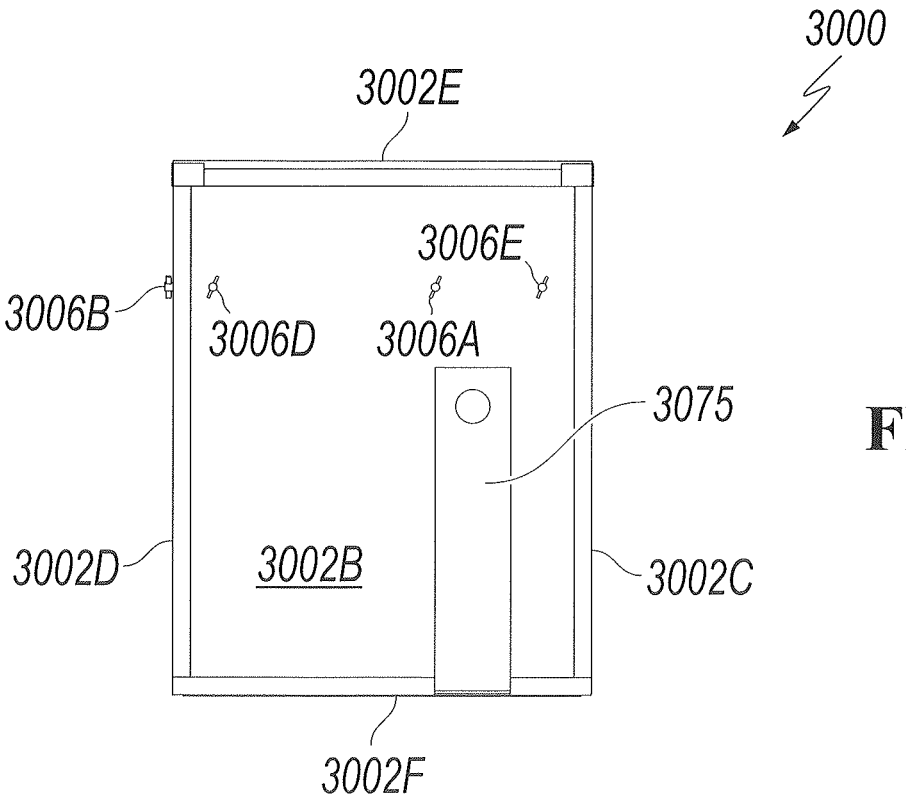
FIG. 9 illustrates a left view of the exemplary go drum of FIG. 1 that is in a storage position.
Figure 10:
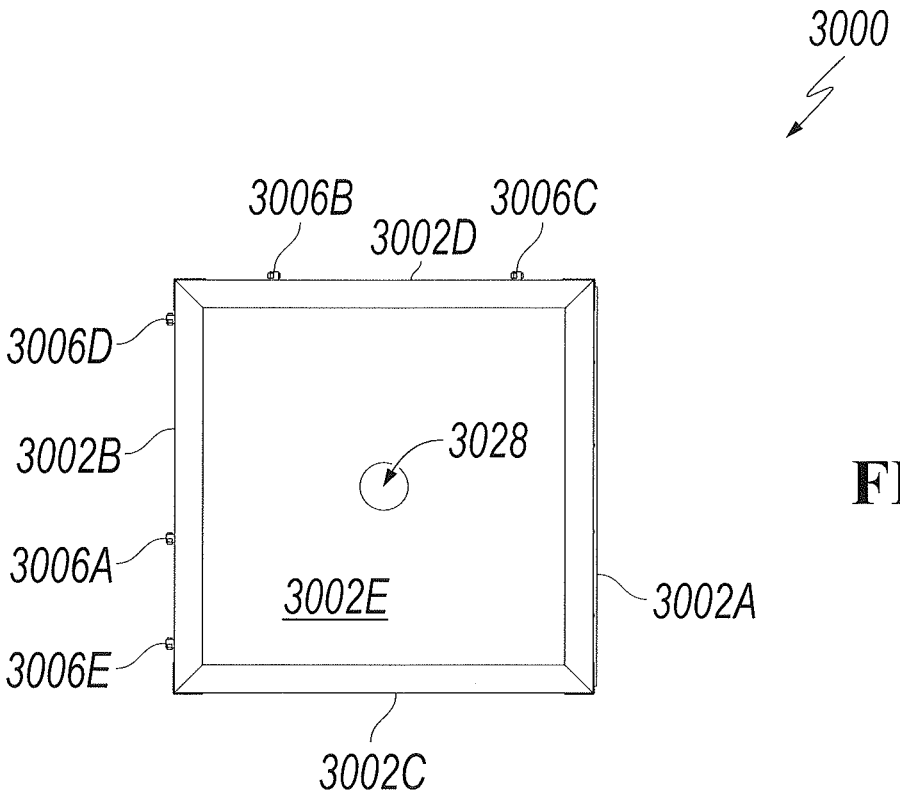
FIG. 10 illustrates a top view of the exemplary go drum of FIG. 1 that is in a storage position.
Figure 11:
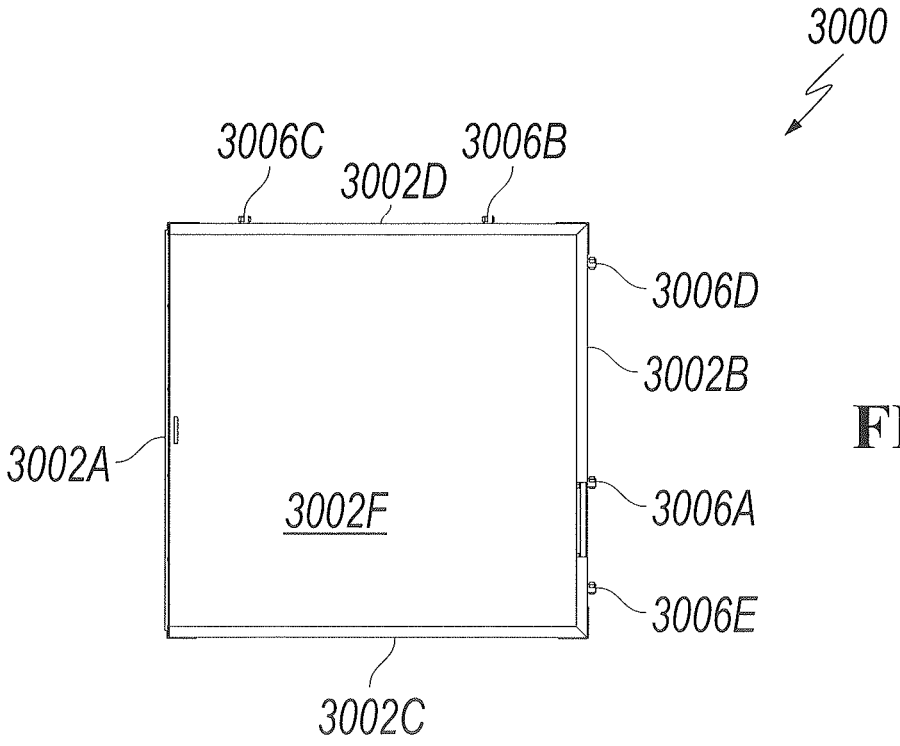
FIG. 11 illustrates a bottom view of the exemplary go drum of FIG. 1 that is in a storage position.

In some other embodiments, as shown in FIGS. 4-5, the hi-hat pedal assembly plate 3075 can be accessed through an access slot or track 3094 opened through the bottom platform 3024 (as shown in FIG. 4). In this configuration, the hi-hat pedal assembly plate 3075 can be slide in and out of the body 3002 through the access slot or track 3094 like a drawer (as shown in FIG. 5).

A hi-hat pedal assembly may be attached to the hi-hat pedal assembly plate 3075 at different distances and angles by means of, for example, velcro, magnets, latches or other fastening mechanisms.

Figure 12:
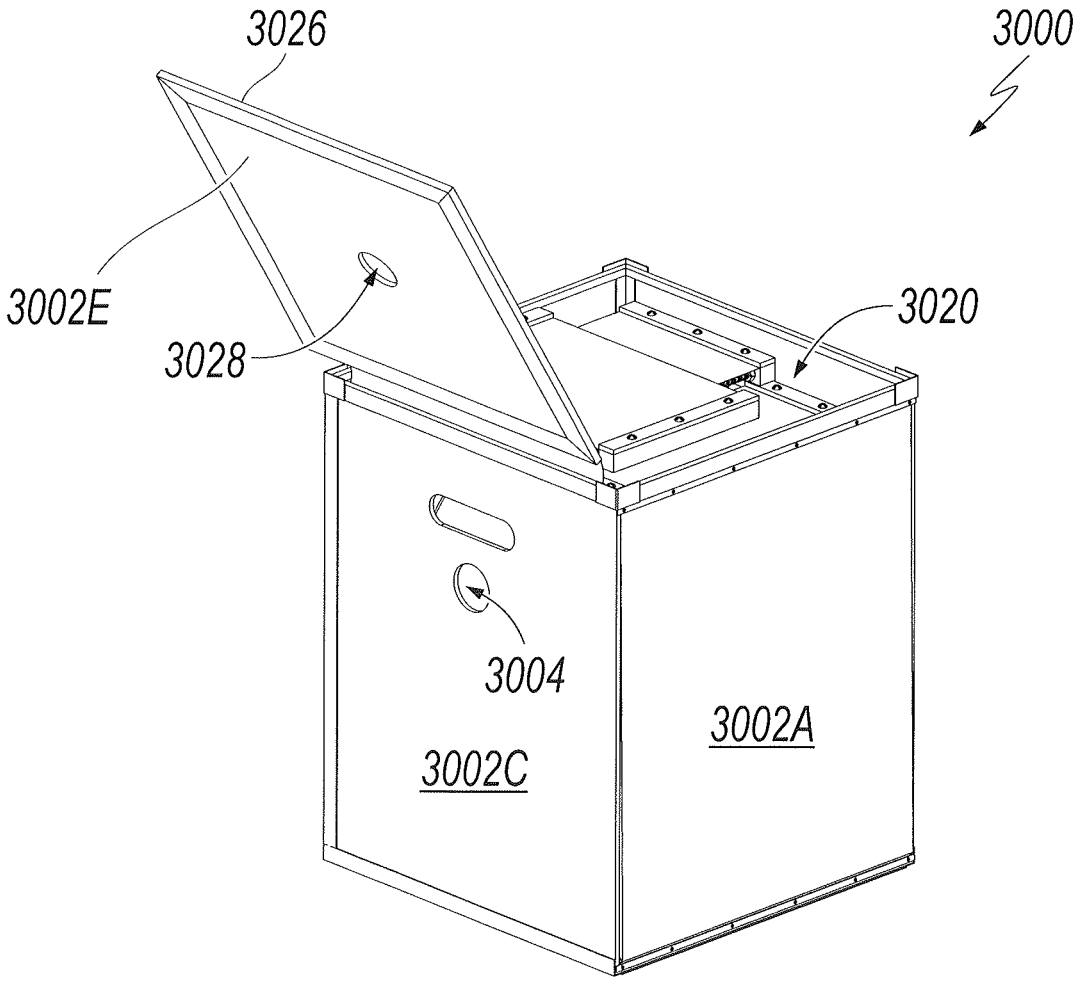
FIG. 12 illustrates a top-front-right perspective view of the exemplary go drum of FIG. 1 with a top plate been half opened to reveal the interior cavity of the go drum.
Figure 13:
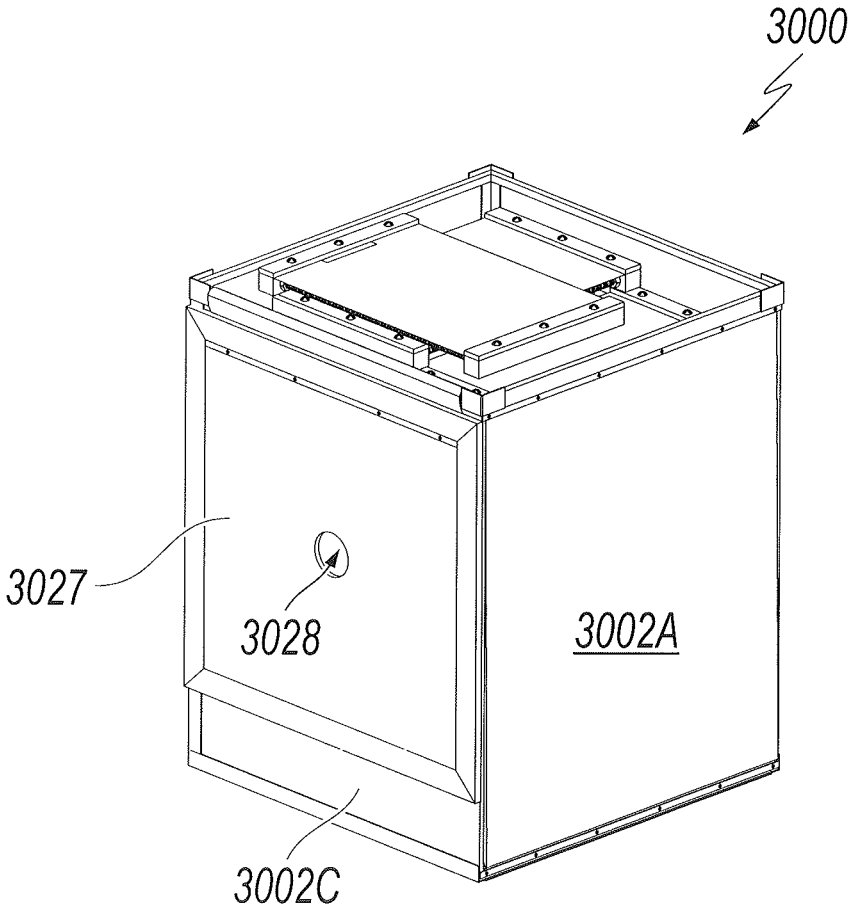
FIG. 13 illustrates a top-front-right perspective view of the exemplary go drum of FIG. 1 with the top plate been fully opened.

FIG. 12 illustrates a top-front-right perspective view of the exemplary go drum 3000 with the top plate 3026 been half opened to reveal the interior cavity 3020 of the go drum. FIG. 13 illustrates a top-front-right perspective view of the exemplary go drum 3000 with the top plate 3026 been fully opened. The top plate 3026 can be hingedly connected at the edge between the top side 3002E and front side 3002C that when the top plate 3026 is fully opened, by turning 90° from a horizontal position to a vertical position, the interior side 3027 of the top plate 3026 is facing in the same direction as the front side 3002C and the top plate 3026 covers a portion of the front side 3002C. The top plate 3026 can have a hole 3028 configured to be aligned with the sound hole 3004 on the front side 3002C when the top plate 3026 is fully opened that sound waves carrying resonant frequencies due to oscillations of the resonant head 3002B would travel through both sound hole 3004 on the front side 3002C and the hole 3028 on the top plate 3026.

Figure 14:
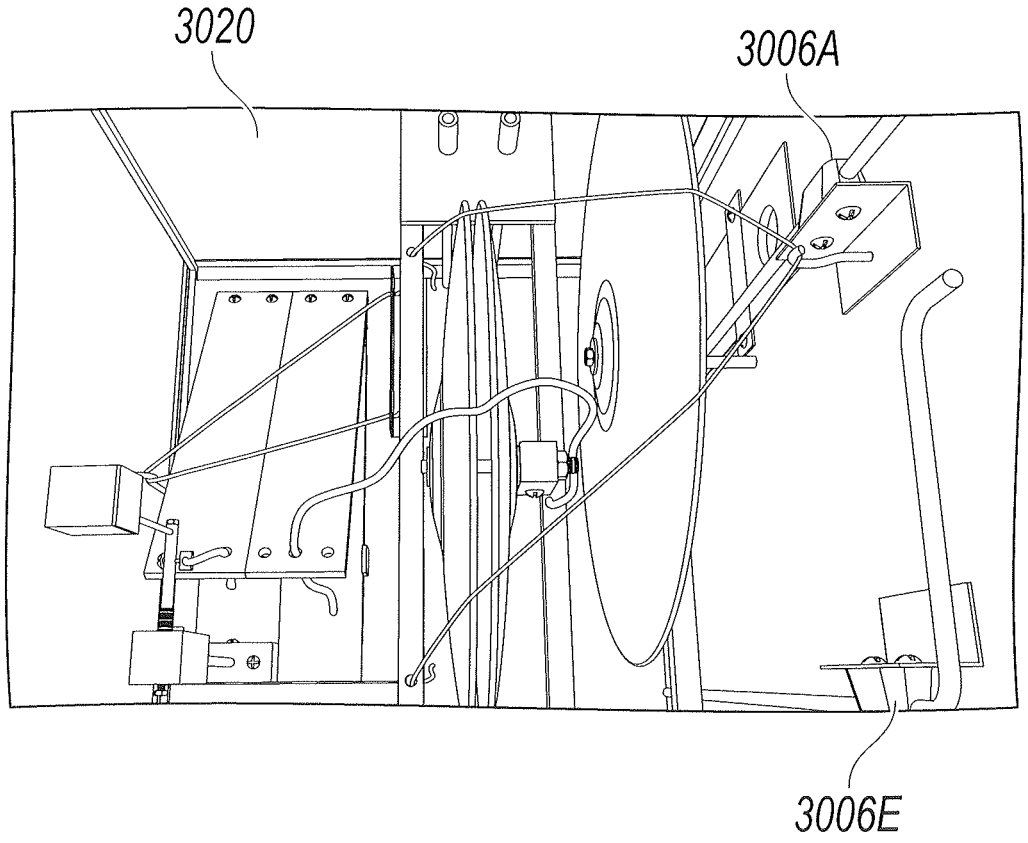
FIG. 14 illustrates a top view of the go drum of FIG. 1 with the top plate opened to show a portion of one embodiment of the interior cavity.
Figure 15:
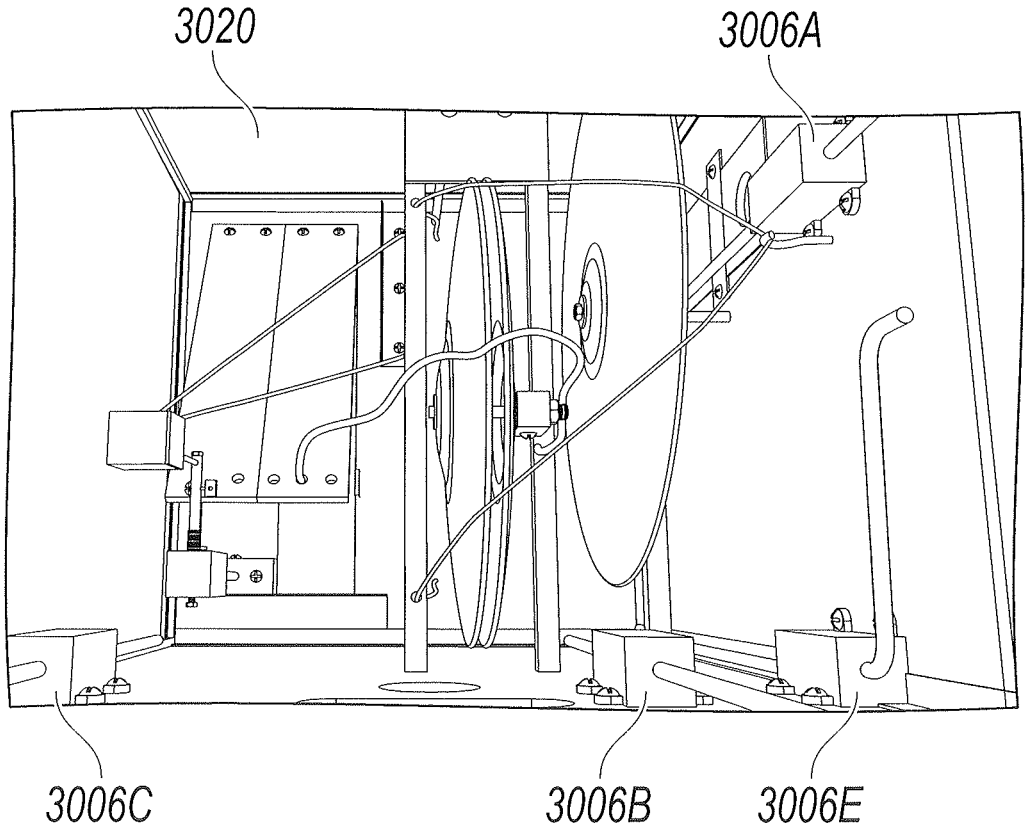
FIG. 15 illustrates a top view of the go drum of FIG. 1 with the top plate opened to show a portion of another embodiment of the interior cavity.

FIGS. 14-15 illustrate a variety of top views of the go drum 3000 with the top plate been opened to show a portion of the interior cavity 3020 with components stored in the interior cavity 3020. As shown, components and their corresponding component shafts are packed within the interior cavity 3020 of body 3002.

Figure 16:
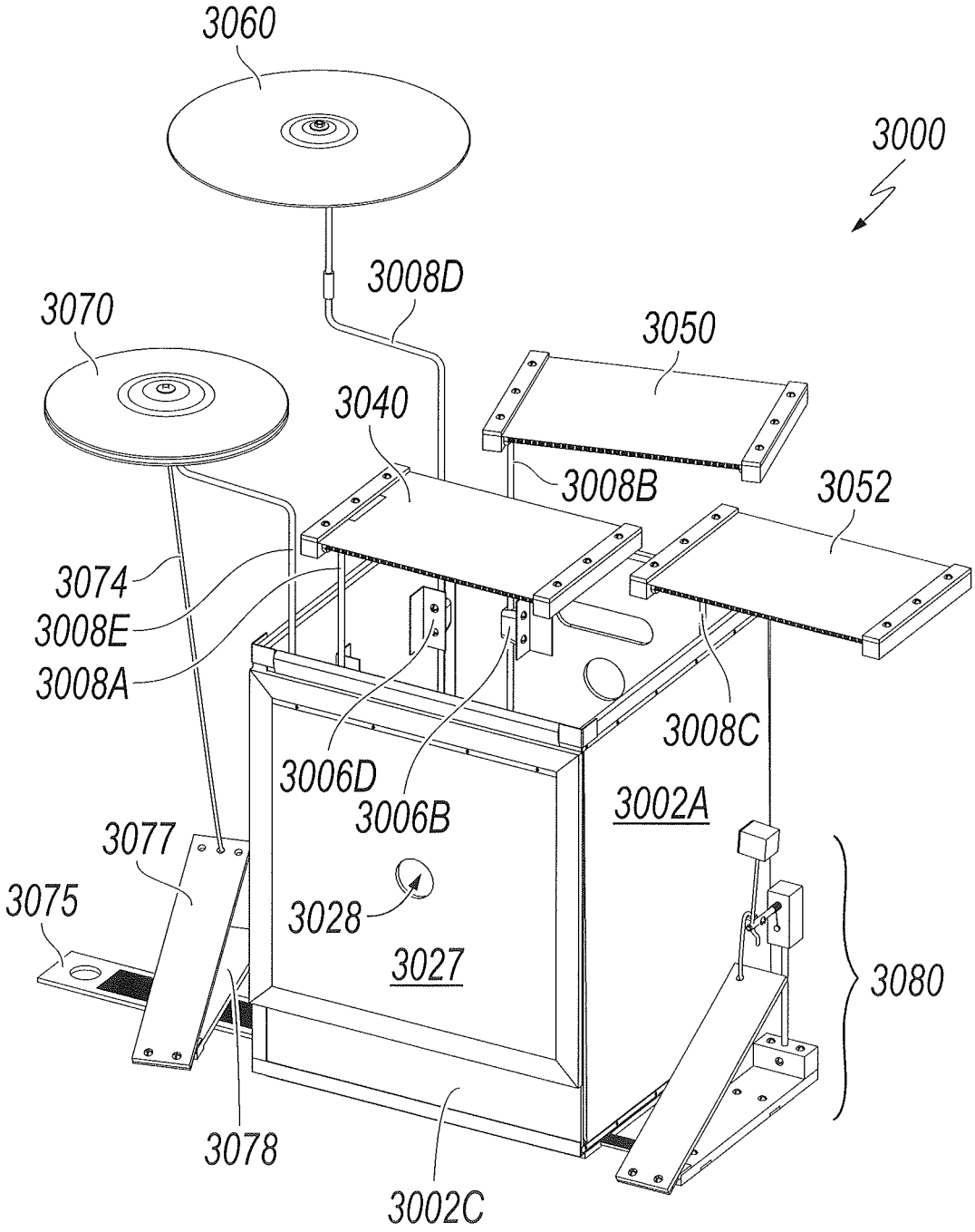
FIG. 16 illustrates a top-front-right perspective view of the exemplary go drum that is in an usage position.
Figure 17:
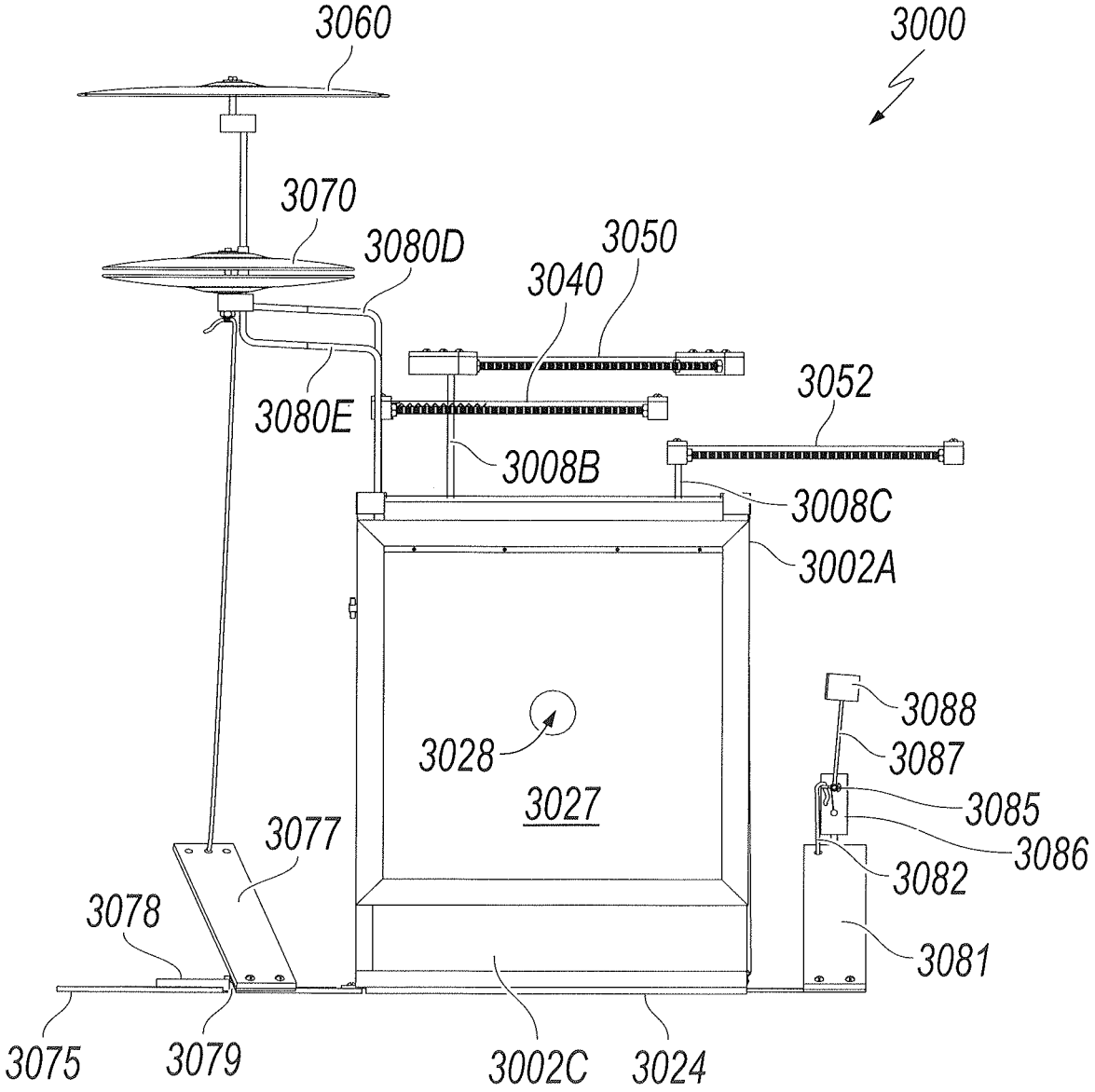
FIG. 17 illustrates a front view of the exemplary go drum of FIG. 16.
Figure 18:
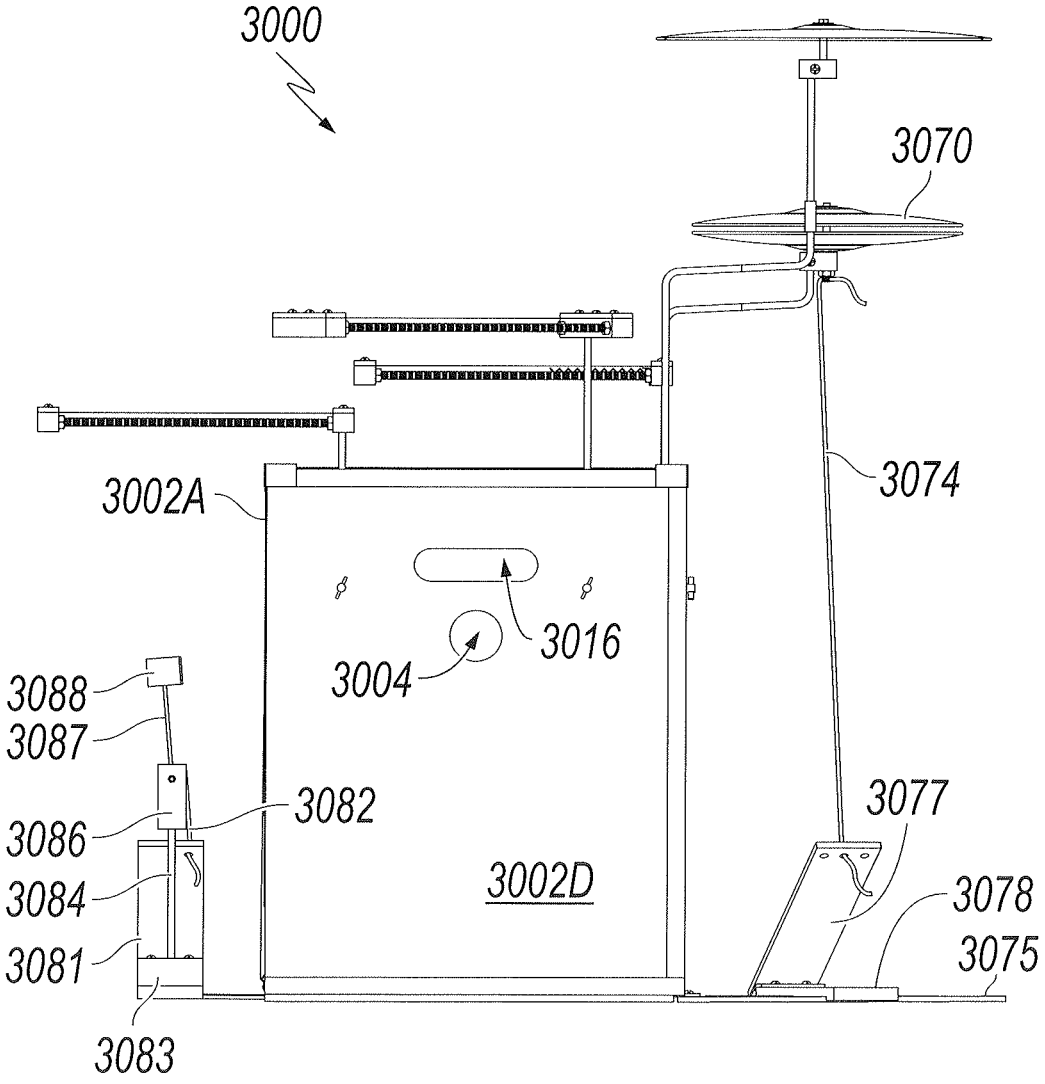
FIG. 18 illustrates a rear view of the exemplary go drum of FIG. 16.
Figure 19:
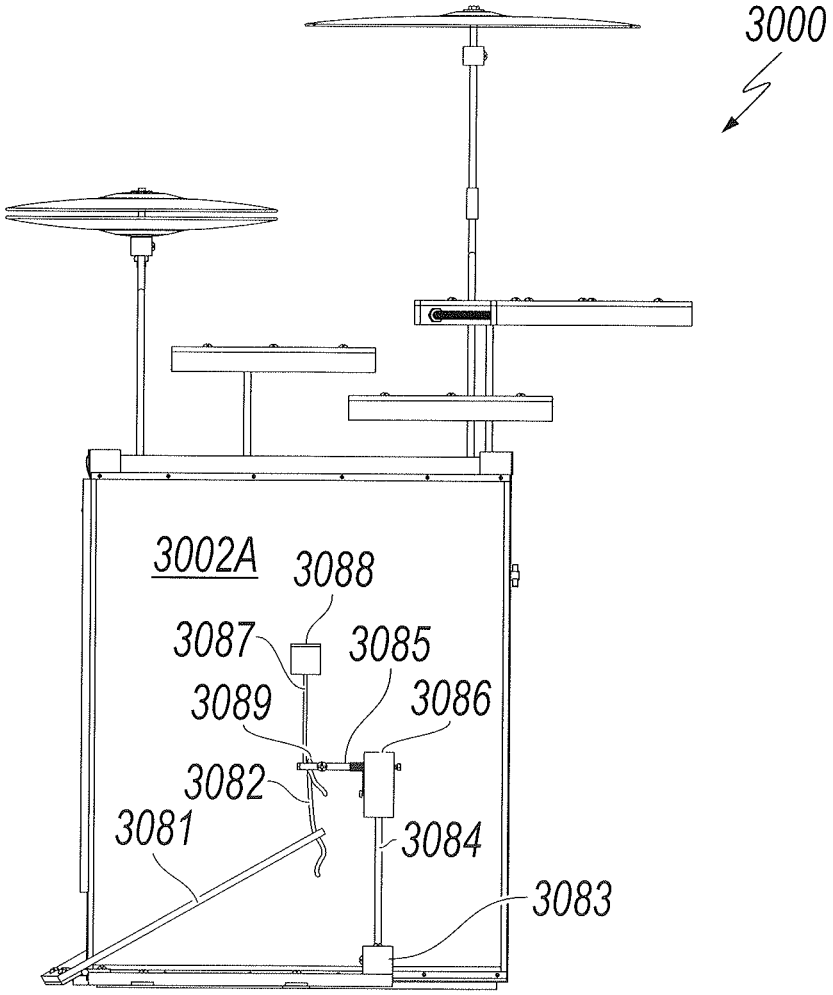
FIG. 19 illustrates a right view of the exemplary go drum of FIG. 16.
Figure 20:
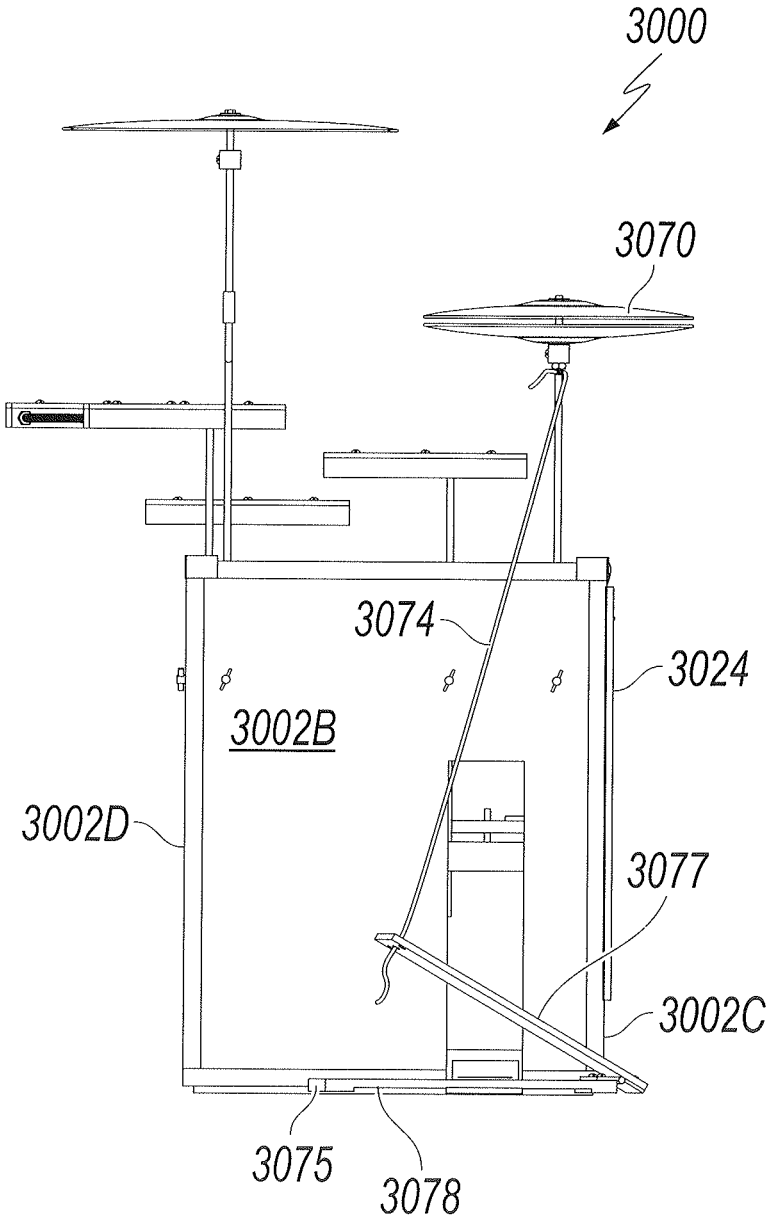
FIG. 20 illustrates a left view of the exemplary go drum of FIG. 16.
Figure 21:
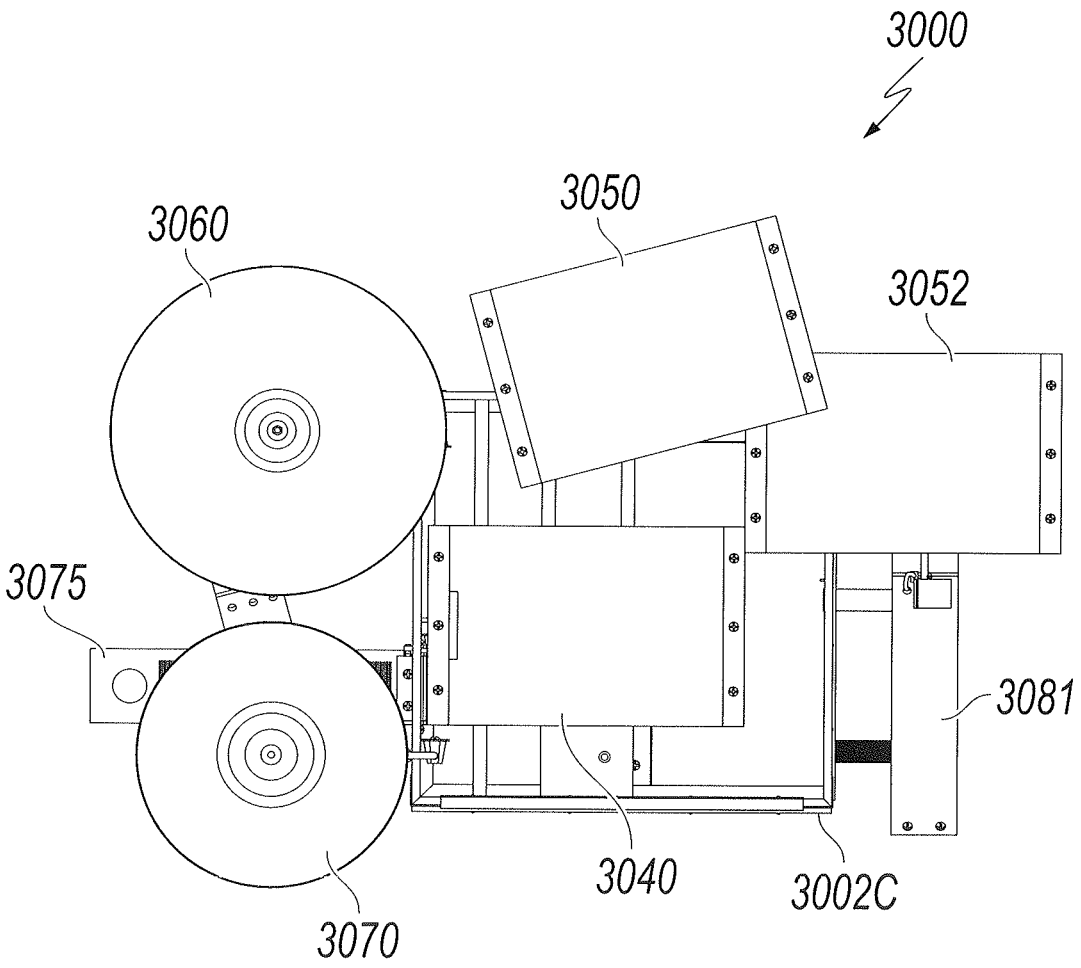
FIG. 21 illustrates a top view of the exemplary go drum of FIG. 16.
Figure 22:
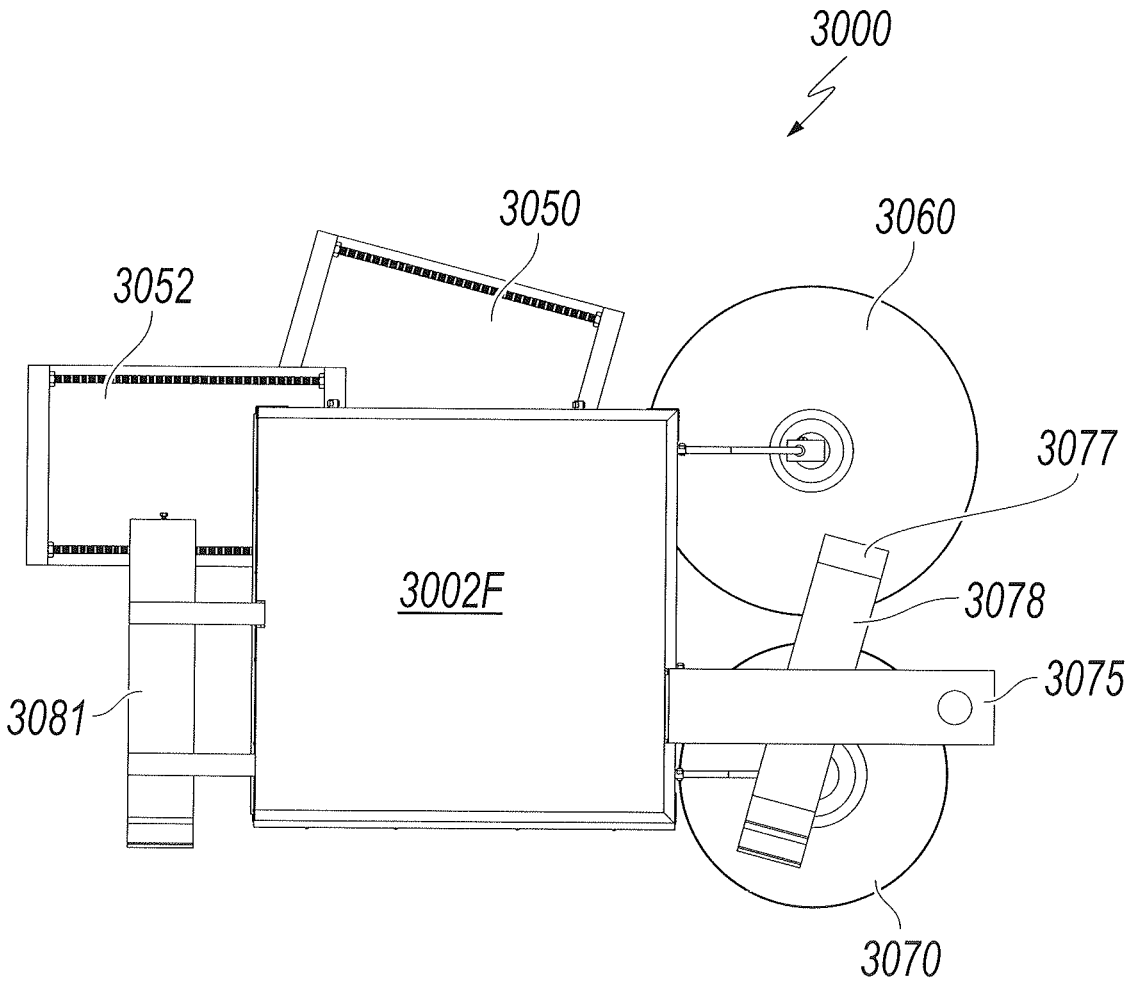
FIG. 22 illustrates a bottom view of the exemplary go drum of FIG. 16.

As shown in FIG. 14, each of the internal part of component shaft locking mechanisms (shown only 3006A, 3006E) is mounted internally on the interior wall of body 3002 with an L-shaped bracket. Each of the internal part of component shaft locking mechanisms work together with the external part of component shaft locking mechanisms (shown as wing screws) in FIGS. 2-10. Referring also to FIG. 16, drum components 3040, 3050, 3052, 3060, 3070 are mounted on component arms or shafts 3008A-3008E, respectively. The component arms or shafts 3008A-3008E are clamped into the desired position by component shaft locking mechanisms 3006A-3006E, respectively. In the figures, component shaft locking mechanisms 3006A-3006E are shown as internally mounted clamping units mounted on brackets inside body 3002. The clamping screws (e.g., thumb screw or a wing screw) protrude from the exterior of body 3002 to lock or unlock the component shafts by adjusting or rotating the clamping screws.

FIGS. 23-27 illustrate a variety of views of an exemplary component shaft (or arm) locking mechanism (or clamping mechanism) 3106 according to some embodiments. Component shaft locking mechanism 3106 showing in FIGS. 23-27 can be used to replace one or more of component shaft locking mechanisms 3006A-3006E showing in FIGS. 1-22.

Component shaft locking mechanism 3106 includes generally a body which may be defined by a first mounting side 3110, a second mounting side 3112, a top side 3114, a bottom side and one or more internally facing sides. Particular embodiments of the body of component shaft locking mechanism 3106 may be a polyhedron of any three dimensional shape, including, but not limited to, a rectangular parallelepiped, a cube, a cylinder that is round or having a top and bottom of any other polygonal shape. In particular embodiments, component shaft locking mechanism 3106 is made of metal.

In particular embodiments, one or more mounting screw holes 3120 can be provided as extension or extensions of body of component shaft locking mechanism 3106 along the first mounting side 3110 configured to facilitate the mounting of component shaft locking mechanism 3106 to the go drum 3000 showing in FIGS. 1-22. In particular embodiments, one or more additional mounting screw holes 3120 can be provided as extension or extensions of body of component shaft locking mechanism 3106 along the second mounting side 3112. In particular embodiments, component shaft locking mechanism 3106 is mounted on the interior cavity 3020 of body 3002. In particular embodiments, component shaft locking mechanism 3106 is mounted along a corner edge in the interior cavity 3020 of body 3002.

Figure 23:
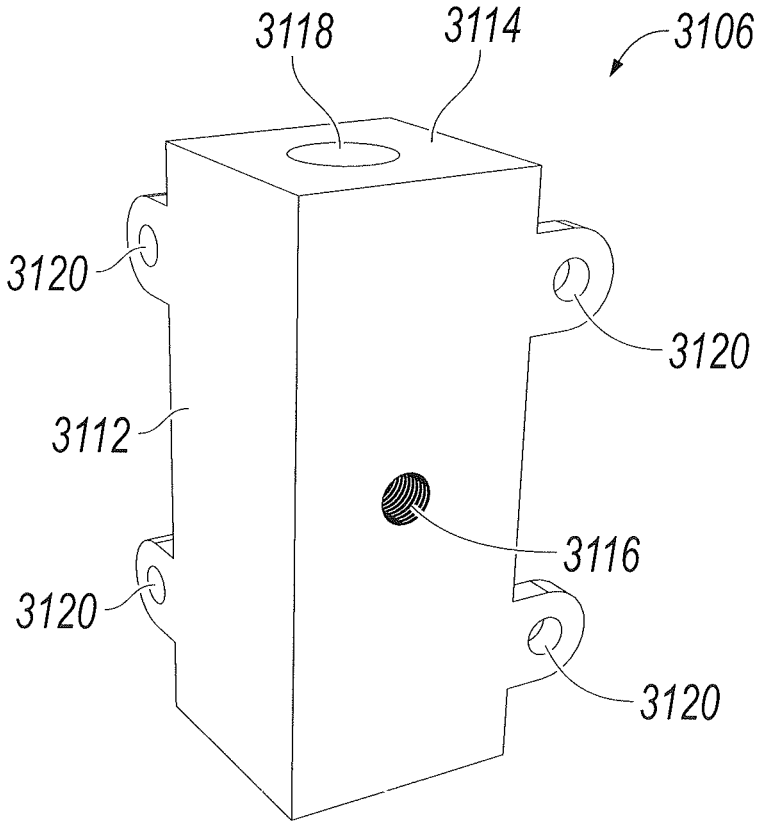
FIG. 23 illustrates a perspective view of an exemplary component shaft locking mechanism without showing a locking screw.
Figure 24:
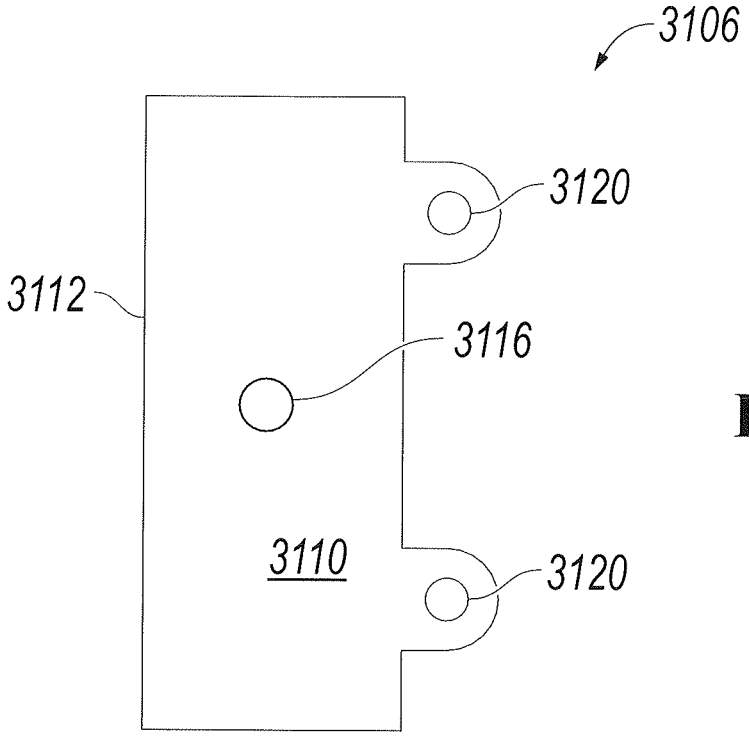
FIG. 24 illustrates a side view of the exemplary component shaft locking mechanism of FIG. 23.
Figure 25:
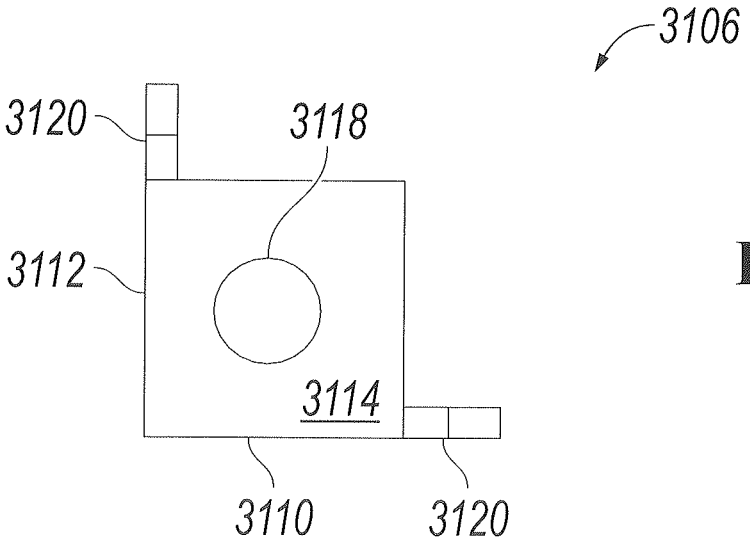
FIG. 25 illustrates a top view of the exemplary component shaft locking mechanism of FIG. 23.
Figure 26:
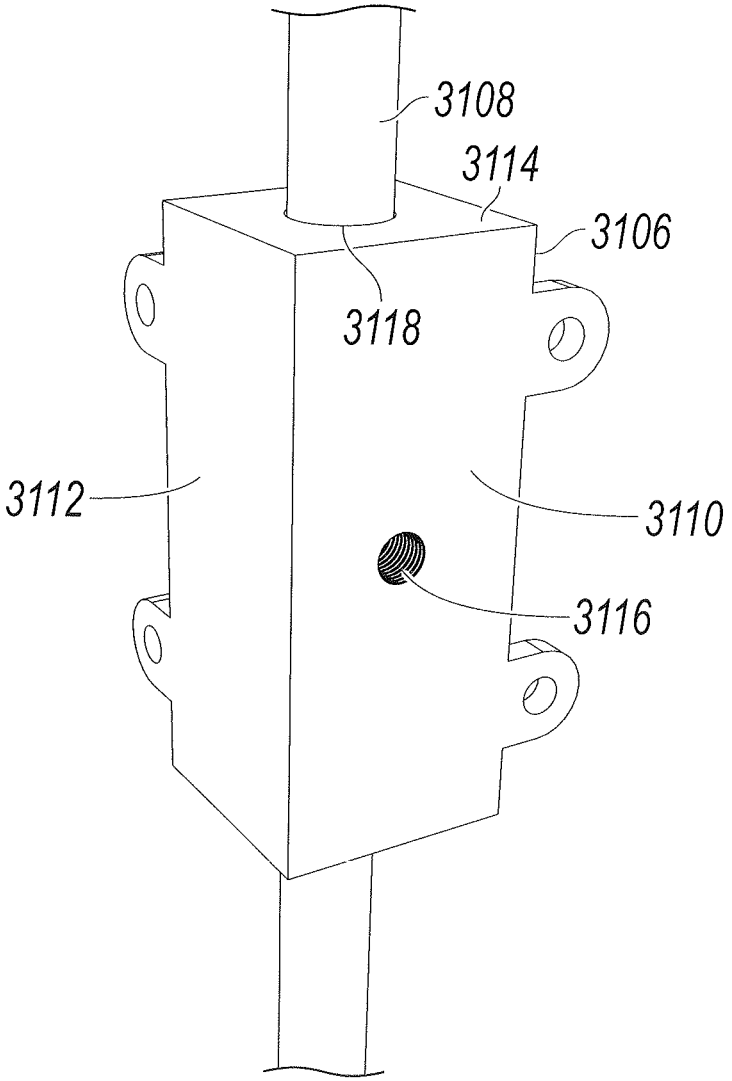
FIG. 26 illustrates a perspective view of the exemplary component shaft locking mechanism of FIG. 23 with a component shaft.

A component shaft hole 3118 sized to accept a component shaft or arm 3108 can be opened through the top side 3114 and the bottom side. Component shaft 3108 shown in FIGS. 27-28 can be any one of the component shaft or arm 3008A-3008E showing in FIGS. 1-22. A clamping screw hole 3116 sized to accept a clamping screw (e.g., thumb screw or a wing screw) 3109 can be opened through the first mounting side 3110 as shown in FIGS. 23, 24, 26. Clamping screw hole 3116 is configured to have an internal thread to mate with clamping screw 3109 that when component shaft 3108 is within component shaft hole 3118 of component shaft locking mechanism 3106, component shaft 3108 can be fastened to, or released from, a desired position by rotating the clamping screw 3109 in one direction or another.

Figure 27:
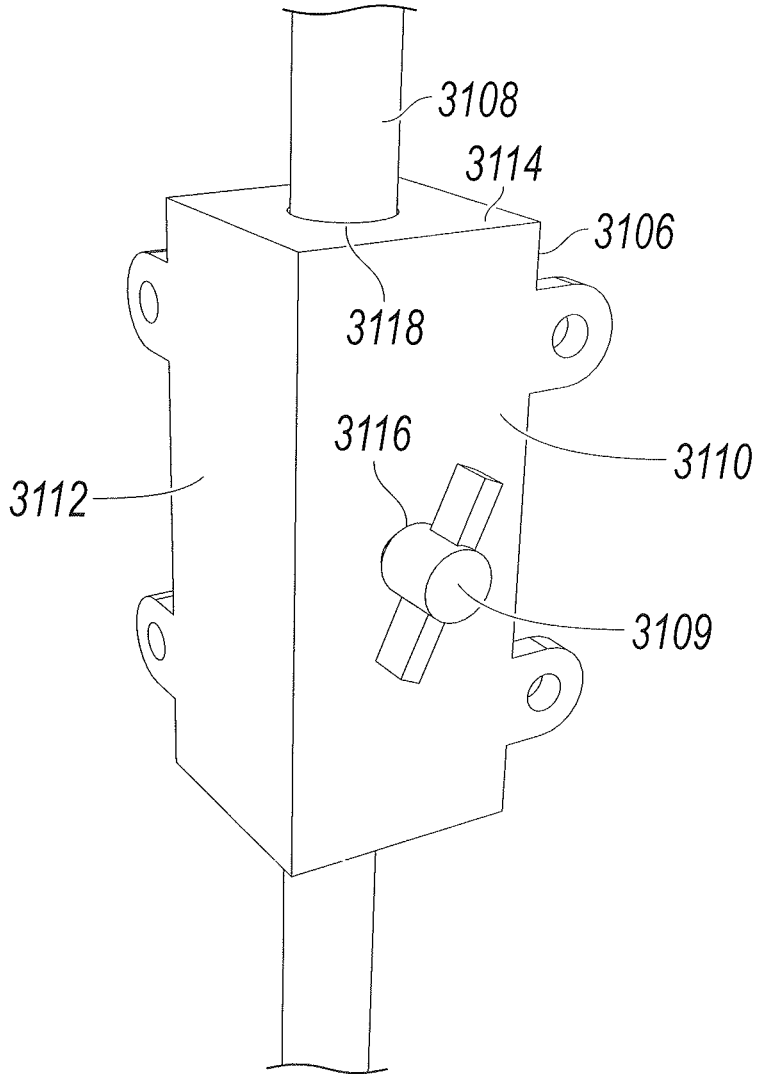
FIG. 27 illustrates a perspective view of the exemplary component shaft locking mechanism of FIG. 23 with a component shaft and a locking screw.

Although the clamping screw 3109 shown in FIG. 27 is closed to the first mounting side 3110 of component shaft locking mechanism 3106, it is understood by a person skilled in the art that when the component shaft locking mechanism 3106 is installed with the go drum 3000, the clamping screw 3109 would be further departed away from the first mounting side 3110 with a distance at least the thickness of body 3002.

Figure 28:
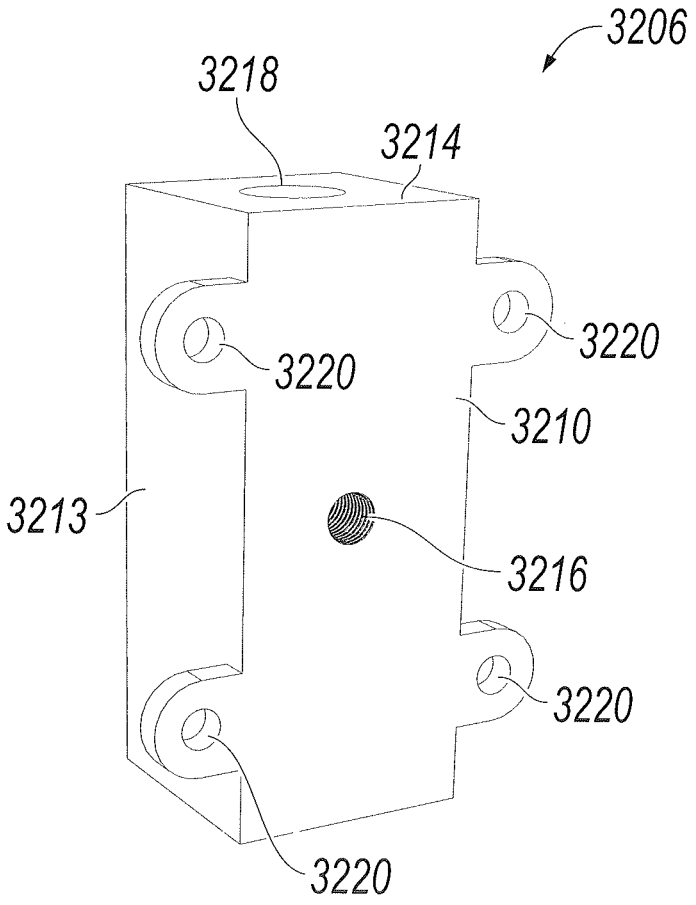
FIG. 28 illustrates a perspective view of another exemplary component shaft locking mechanism without showing a locking screw.
Figure 29:
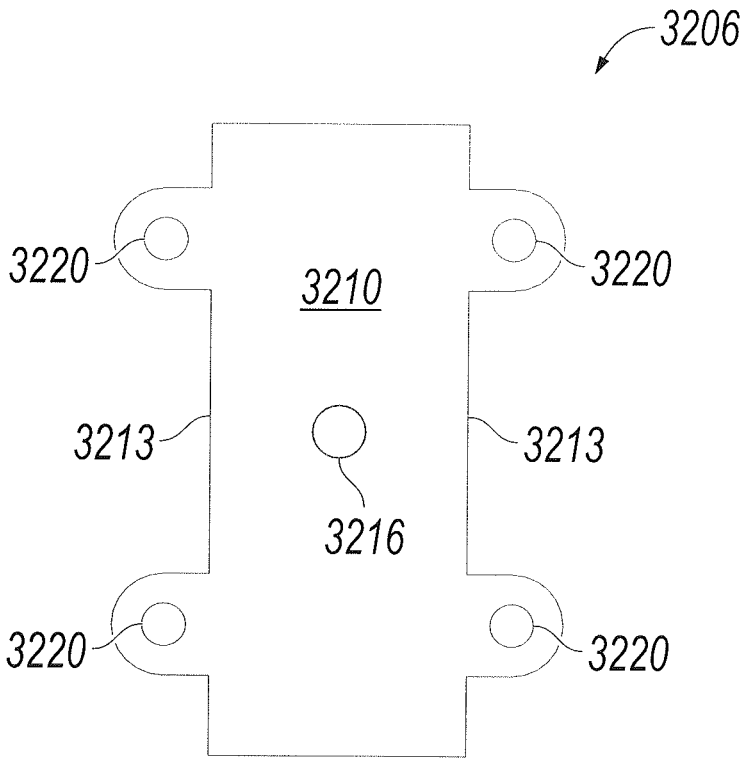
FIG. 29 illustrates a side view of the exemplary component shaft locking mechanism of FIG. 28.
Figure 30:
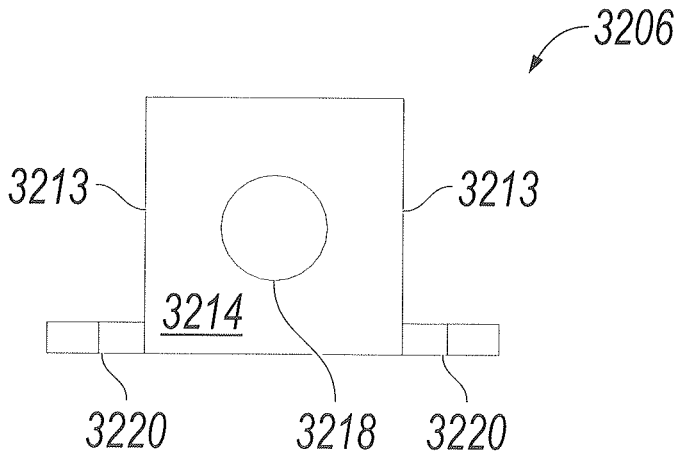
FIG. 30 illustrates a top view of the exemplary component shaft locking mechanism of FIG. 28.

FIGS. 28-30 illustrate a variety of views of another exemplary component shaft (or arm) locking mechanism (or clamping mechanism) 3206 that can be used to replace one or more of the component shaft locking mechanisms 3006A-3006E showing in FIGS. 1-22.

Component shaft locking mechanism 3206 includes generally a body which may be defined by a mounting side 3210, a top side 3114, a bottom side and one or more internally facing sides 3213. Particular embodiments of the body of component shaft locking mechanism 3206 may be a polyhedron of any three dimensional shape, including, but not limited to, a rectangular parallelepiped, a cube, a cylinder that is round or having a top and bottom of any other polygonal shape. In particular embodiments, component shaft locking mechanism 3206 is made of metal.

In particular embodiments, one or more mounting screw holes 3220 can be provided as extension or extensions of body of component shaft locking mechanism 3206 along the mounting side 3210 configured to facilitate the mounting of component shaft locking mechanism 3206 to the go drum 3000 showing in FIGS. 1-22. In particular embodiments, component shaft locking mechanism 3206 is mounted on the interior cavity 3020 of body 3002. In particular embodiments, component shaft locking mechanism 3206 is mounted away from a corner edge in the interior cavity 3020 of body 3002.

A component shaft hole 3218 sized to accept a component shaft or arm can be opened through the top side 3214 and the bottom side. Component shaft can be any one of the component shaft or arm 3008A-3008E showing in FIGS. 1-22. A clamping screw hole 3216 sized to accept a clamping screw (e.g., thumb screw or a wing screw) can be opened through the mounting side 3210 as shown in FIGS. 28-29. Clamping screw hole 3216 is configured to have an internal thread to mate with clamping screw accessible from the exterior of the go drum that when component shaft is within component shaft hole 3218 of component shaft locking mechanism 3206, component shaft can be fastened to, or released from, a desired position by rotating the clamping screw in one direction or another from the exterior of the go drum.

FIGS. 16-22 illustrate a variety of views of the exemplary go drum 3000 that is in an usage position according to the present disclosure. Component shafts 3008A-3008E are secured into place by component shaft locking mechanisms 3006A-3006E, respectively. Each of the component shaft locking mechanisms 3006A-3006E locks and unlocks to allow corresponding component shafts 3008A-3008E to move up and/or move down freely or to securely fix component shafts 3008A-3008E into a particular position. In particular embodiments, each of the component shaft locking mechanisms 3006A-3006E may allow corresponding component shafts 3008A-3008E to rotate on its lengthwise axis or remain at a fixed rotation relative to body 3002. In particular embodiments, there may be more or less component shafts depending on the number of desired components for a particular go drum 3000.

In particular embodiments, component shafts 3008A-3008E can be lowered and rotated so that corresponding components 3040, 3050, 3052, 3060, 3070 can be placed at positions for storage and/or transportation. In particular embodiments, component shafts 3008A-3008E can be raised and rotated so that corresponding components 3040, 3050, 3052, 3060, 3070 can be placed at positions for usage, e.g., practice, performance, etc.

In the example embodiments illustrated in the figures, each of the component shafts 3008A-3008E is straight for at least a portion of its length. The straight portion of each of the component shafts 3008A-3008E is primarily so that component shafts may be locked at various heights from storage and/or transport position as shown in FIGS. 1-15 to fully extended the full length of component shafts for usage position as shown in FIGS. 16-22, such that it may still be locked into place with corresponding component shaft locking mechanisms 3006A-3006E. In particular embodiments, component shafts 3008A-3008C may be entirely straight as shown in along its length or any other shape along its length facilitate fastening components to the outside of the body 3002.

In the example embodiments illustrated in the figures, each of component shafts 3008D-3008E is curved for another portion of its length. In particular embodiments, the curved portion of component shafts 3008D-3008E may be curved in the shape of an "L", or at any other degree or angle in which to allow each of the corresponding components to be extended away and fastened above body 3002.

Component shafts 3008D-3008E may be smooth, knurled, or spline. In particular embodiments, a portion of component shafts 3008D-3008E may be smooth and another portion of component shafts 3008D-3008E may be knurled. In particular embodiments, component shafts 3008D-3008E may be smooth, knurled, or spline in its entirety. In particular embodiments, component shafts 3008D-3008E may be solid or hollow. In particular embodiments. component shafts 3008D-3008E may be made of any suitable material, including but not limited to wood, carbon fiber, fiberglass, metal, or plastic.

Although component shaft locking mechanisms 3006A-3006E are shown as a thumb screw or a wing screw, component shaft locking mechanisms 3006A-3006E may be any suitable locking mechanisms.

As is shown in the figures, various components 3040, 3050, 3052, 3060, 3070 are attached to various component shafts 3008A-3008E, respectively. In particular embodiments, components 3040, 3050, 3052, 3060, 3070 are removably attached to component shafts 3008A-3008E, respectively. Alternatively, components 3040, 3050, 3052, 3060, 3070 are attached to component shafts 3008A-3008E, respectively, by collar lock, thereby fixing the components in place. In particular embodiments, each of the components 3040, 3050, 3052, 3060, 3070 are sit on top of corresponding component shafts 3008A-3008E, respectively. Although particular components 3040, 3050, 3052, 3060, 3070 are shown attached to specific component shafts 3008A-3008E, respectively, it is understood by one in the art that each of the components may be attached to different component shafts in different configurations.

Referring also to FIGS. 16-22, which illustrate a variety of views of the exemplary go drum 3000. In particular embodiments, component 3040 can be a snare drum. Snare drum 3040 has a snare head for accepting striking and an opposing lower skin. In particular embodiments, snare drum 3040 may have a frame comprising any shape, including but not limited to a square, rectangle, circle, or other polygon having a plurality of sides. In particular embodiments, snare drum 3040 comprises a series of stiff wires held under tension against the lower skin of the snare drum 3040. In particular embodiments, snare drum 3040 may be independent of body 3002 and merely be placed on the top of body 3002. In particular embodiments, snare drum 3040 may be integrated into the top plate 3026, where the top plate 3026 comprises a frame surrounding the strikable surface of snare drum 3040. In particular embodiments, the top plate 3026 may itself be snare drum 3040. In particular embodiments, snare drum 3040 may be composed of mylar. In particular embodiments, snare drum 3040 may be tunable. In particular embodiments, snare drum 3040 is tuned by means of one or more rods. In particular embodiments, snare drum 3040 may be tunable and comprised of mylar.

As is shown in the figures, each of components 3050, 3052 are fixed atop component shafts 3008B, 3008C, respectively. In particular exemplary embodiments, components 3050, 3052 may be one or more tom-tom drums. In particular embodiments, components 3050, 3052 may be a typical tom-tom drums, including a high tom 3050 and a low tom 3052. Each of the tom-tom drums 3050, 3052 may comprise a cylindrical drum with no snares comprising a shell, a rim, and a head. In particular exemplary embodiments, each of the components 3050, 3052 is a tom-tom comprising a frame and a head. In particular embodiments, each of the tom-tom drums 3050, 3052 has a head comprising mylar. In particular embodiments, each of the tom-tom drums 3050, 3052 may be a different size and pitch, such as hi, mid, or low. In particular embodiments, each of the tom-tom drums 3050, 3052 may have a frame comprising any shape, including but not limited to a square, rectangle, circle, or other polygon having a plurality of sides. In particular embodiments, each of the tom-tom drums 3050, 3052 may be adjustable so that it may tuned to project sounds of different pitch. In particular embodiments, tom-tom drums 3050, 3052 can be tuned by means of one or more tension rods.

As is shown in the figures, component 3060 is fixed atop a component shaft 3008D. In particular exemplary embodiments, component 3060 may be a cymbal. In particular embodiments, component 3060 may be one or more cymbals. In particular embodiments, component 3060 may be a crash, ride, or crash/ride cymbal.

As is shown in the figures, component 3070 is fixed atop a component shaft 3008E. In particular exemplary embodiments, component 3070 may be a pair of hi-hat cymbals.

Referring also to FIGS. 16, 17, 18, 20, hi-hat pedal assembly 3072 is shown to the left of body 3002 so that a left foot of a drummer may operate hi hat pedal assembly 3072 and pulling connector 3074, thus, causing component 3070 to project sound. In particular embodiments, pulling connector 3074 may be a string, rope, cable or wire that is inelastic or elastic or sinewy material.

As is shown in the figures, hi-hat pedal assembly 3072 comprises a number of parts, including footboard 3077, base plate 3078 and connector 3079. In particular embodiments, connector 3079 may be a heel hinge, such as a heel hinge that connects footboard 3077 and base plate 3078. In particular embodiments, pulling connector 3074 is attached to footboard 3077 opposite to connector 3074. In particular embodiments, hi-hat pedal assembly 3072 is mounted to the platform 3024.

As shown in FIGS. 2-3, the hi-hat pedal plate 3075 can form a part of the body 3002 during storage mode and can fold out during play mode. Alternatively, as shown in FIGS. 4-5, the hi-hat pedal plate 3075 can be accessed through the access slot 3094 that the hi-hat pedal plate 3075 can slide in and out of the body 3002 through the access slot 3094 like a drawer.

In particular exemplary embodiments, hi-hat pedal plate 3075 is secured into place by hi-hat pedal plate locking mechanism. Hi-hat pedal plate locking mechanism can be unlocked to allow plate 3075 to swivel away from and toward relative to the platform 3024 or can be locked to securely fix hi-hat pedal plate 3075 into a particular position. Hi-hat pedal plate locking mechanism may be any suitable locking mechanisms. Hi-hat pedal plate 3075 can be made of metal according to some embodiments.

As is shown in the figures, hi-hat pedal assembly 3072 (including footboard 3077, base plate 3078 and connector 3079) is mounted on the hi-hat pedal plate 3075 according to some embodiments. In some embodiments, hi-hat pedal assembly 3072 is magnetically mounted on the hi-hat pedal plate 3075. In this regard, hi-hat pedal assembly 3072 can be mounted on the hi-hat pedal plate 3075 with a variety of locations and/or positions with a variety of directions by disengaging/engaging the magnetic connection between the hi-hat pedal assembly 3072 and the hi-hat pedal plate 3075. Base plate 3078 can be made of a magnetic material according to some embodiments.

An angle formed by the longitudinal direction of the hi-hat pedal assembly 3072 and a side of the platform 3024 can varies by adjusting the hi-hat pedal assembly 3072 relatively to the hi-hat pedal plate 3075. With the configurations provided, hi-hat pedal assembly 3072 can have a variety of angles relative to the drummer. In addition, hi-hat pedal assembly 3072 can have various distance away from the platform 3024.

Referring also to FIGS. 16-19, drum kick assembly 3080 is positioned to the right of body 3002 so that a right foot of a drummer may operate drum kick assembly 3080. In particular exemplary embodiments, drum kick assembly 3080 comprises a number of parts, including a drum pedal 3081, a pedal rod 3082, a kick pedal bar 3083, a beater mount 3084, a spring 3085, a connector 3086, a beater extension 3087, a beater 3088, and a connector rod 3089. In particular embodiments, drum kick assembly 3080 is mounted on the platform 3024.

In particular embodiments, drum pedal 3081 is attached to the platform 3024 by a heel hinge at one end of the drum pedal 3081. The other end of the drum pedal 3081 is attached to one end of the pedal rod 3082. The other end of the pedal rod 3082 is attached to the connector rod 3089 with a lever. One end of the connector rod 3089 is attached to one end of the beater extension 3087 which in turn also attached to the beater 3088 on the other end. The other end of the connector rod 3089 is connected to the connector 3086 and biased by spring 3085. The connector 3086 in turn is also connected to the beater mount 3084, which in turn is also connected to kick pedal bar 3083, which in turn is also connected to the platform 3024.

When drum pedal 3081 is pressed downward, it pulls pedal rod 3082 downward, which generates an angular force to overcome the spring biased force from the spring 3085 to force the connector rod 3089 to rotate, which in turn pulls beater extension 3087 toward strike side 3002A of body 3002, which causes beater 3088 to strike side 3002A. When drum pedal 3081 is released, each moving component of drum kick assembly 3080 moves in the opposite direction because the spring force from the spring 3085 rotates the connector rod 3089, which in turn pulls beater extension 3087 away from the striking side 3002A, returning drum pedal 3081 and beater 3088 into their original positions.

Particular embodiments of go drum 3000 may be acoustic, electric, or MIDI. With the addition of particular types of pickups strategically placed on body 3002 and each of the components, particular embodiments of go drum 3000 may produce an amplified or digitized sound.

Although it is not shown on go drum 3000, body 3002 may have another hole or receptacle attached to body 3002 for the storage and retrieval of drum sticks.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

This disclosure encompasses all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

The invention claimed is:

1. A compact drum kit comprising:

a multi-sided body having a hollow interior cavity and at least one sound hole for transmitting sound wave from the interior cavity to exterior of the body, the body has a striking head and an opposing resonant head;

a top plate attaching to a top side of the body;

a bottom platform attaching to a bottom side of the body;

a plurality of upward extending component mounting shafts;

one or more percussion modules that attach to one or more of the plurality of component mounting shafts, wherein each percussion module produces a sound in response to being struck or scraped;

a drum kick assembly positioned on the striking head side of the body and including a beater positioned to strike the striking head of the body to produce a sound;

a hi-hat pedal assembly positioned on the resonant head side of the body; and a hi-hat pedal assembly plate pivotally connected to the bottom platform, wherein the hi-hat pedal assembly is attached to the hi-hat pedal assembly plate.

2. The compact drum kit of claim 1, wherein the hi-hat pedal assembly plate is pivotally connected to the bottom platform through a hinge.

3. The compact drum kit of claim 1, wherein the hi-hat pedal assembly has a footboard, a base plate and a connector connecting the footboard and base plate.

4. The compact drum kit of claim 3, wherein the base plate is made of a magnetic material.

5. The compact drum kit of claim 1, wherein the one or more percussion modules are one or more of a snare drum, torn-tom, a hi-hat cymbals, and a cymbal.

6. The compact drum kit of claim 1, wherein the hi-hat pedal assembly plate is pivotally connected to the bottom platform that the hi-hat pedal plate forms a portion of the body when the hi-hat pedal assembly plate is folded up for storage.

7. The compact drum kit of claim 6, wherein when the hi-hat pedal assembly plate is folded up, a surface of the hi-hat pedal assembly plate and a surface of the body lay substantially flat.

8. The compact drum kit of claim 6, wherein the hi-hat pedal assembly plate is held closed by magnets.

9. The compact drum kit of claim 1, wherein the hi-hat pedal assembly plate has an access hole configured to facilitate pulling the hi-hat pedal assembly plate pivotally away from the body.

10. The compact drum kit of claim 1, wherein each of the plurality of component mounting shafts is supported by a component shaft locking mechanism mounted in the interior cavity.

11. The compact drum kit of claim 10, wherein the component shaft locking mechanism comprising a rectangular parallelepiped component shaft locking mechanism body defined by a first mounting side, a second mounting side, a top side, a bottom side and internally facing sides, wherein at least one mounting screw hole is provided as extension of the component shaft locking mechanism body along the first mounting side and, and wherein at least one additional mounting screw hole is provided as extension of the component shaft locking mechanism body along the second mounting side.

12. The compact drum kit of claim 11, wherein the component shaft locking mechanism further comprising a component shaft hole opened through the top side and the bottom side and sized to accept one of the plurality of component mounting shafts.

13. The compact drum kit of claim 11, wherein the component shaft locking mechanism further comprising a clamping screw hole opened through the first mounting side and sized to accept a clamping screw accessible from the exterior of the compact drum kit.

14. The compact drum kit of claim 10, wherein the component shaft locking mechanism comprising a rectangular parallelepiped body defined by a mounting side, a top side, a bottom side and one or more internally facing sides, wherein at least two mounting screw holes are provided as extensions of the component shaft locking mechanism body along the mounting side.

15. A compact drum kit comprising:

a multi-sided body having a hollow interior cavity and at least one sound hole for transmitting sound wave from the interior cavity to exterior of the body, the body has a striking head and an opposing resonant head;

a top plate attaching to a top side of the body;

a bottom platform attaching to a bottom side of the body;

a plurality of upward extending component mounting shafts;

one or more percussion modules that attach to one or more of the plurality of component mounting shafts, wherein each percussion module produces a sound in response to being struck or scraped;

a drum kick assembly positioned on the striking head side of the body and including a beater positioned to strike the striking head of the body to produce a sound;

a hi-hat pedal assembly positioned on the resonant head side of the body;

an access slot opened through the bottom platform; and a hi-hat pedal assembly plate accessible through the access slot, wherein the hi-hat pedal assembly is attached to the hi-hat pedal assembly plate.

16. The compact drum kit of claim 15, wherein the hi-hat pedal assembly plate is accessed by sliding in and out of the hi-hat pedal assembly plate through the access slot.

17. The compact drum kit of claim 15, wherein each of the plurality of component mounting shafts is supported by a component shaft locking mechanism mounted in the interior cavity.

18. The compact drum kit of claim 15, wherein the hi-hat pedal assembly has a footboard, a base plate and a connector connecting the footboard and base plate.

19. The compact drum kit of claim 18, wherein the base plate is made of a magnetic material.

20. The compact drum kit of claim 15, wherein the one or more percussion modules are one or more of a snare drum, tom-tom, a hi-hat cymbals, and a cymbal.

* * * * *